US009032667B2

(12) United States Patent
Artwohl et al.

(10) Patent No.: US 9,032,667 B2
(45) Date of Patent: May 19, 2015

(54) ACCESS SYSTEM FOR A TEMPERATURE CONTROLLED STORAGE DEVICE

(71) Applicant: Anthony International, Sylmar, CA (US)

(72) Inventors: Paul Artwohl, Stevensville, MI (US); Jack R. Christensen, Santa Clarita, CA (US); Virginia Ramirez, North Hills, CA (US)

(73) Assignee: Anthony International, Sylmar, CA (US)

( * ) Notice: Subject to any disclaimer, the term of this patent is extended or adjusted under 35 U.S.C. 154(b) by 127 days.

(21) Appl. No.: 13/938,408

(22) Filed: Jul. 10, 2013

(65) Prior Publication Data

US 2015/0013226 A1 Jan. 15, 2015

(51) Int. Cl.

| | |
|---|---|
| ***E05D 15/48*** | (2006.01) |
| ***A47F 3/04*** | (2006.01) |
| ***E05D 15/40*** | (2006.01) |
| ***E05D 13/00*** | (2006.01) |
| ***F25D 23/02*** | (2006.01) |

(52) U.S. Cl.

CPC ..... *A47F 3/043* (2013.01); *E05D 15/40* (2013.01); *E05D 13/1207* (2013.01); *E05F 15/40* (2015.01); *E05F 15/668* (2015.01); *E05F 15/73* (2015.01); *E05F 15/77* (2015.01); *E05Y 2900/106* (2013.01); *F25D 23/02* (2013.01)

(58) Field of Classification Search

CPC ..... E06B 3/50; E06B 3/5054; E06B 3/5063; E05F 1/16; E05F 11/02; E05F 11/04; E05F 11/54; E05F 15/16; E05F 15/1607; E05F 15/1646; E05F 15/1653; E05F 15/1661; F25D 23/021; F25D 23/024; F25D 23/025; F25D 2323/023; A47F 2003/008; A47F 3/007; A47F 3/0434; A47F 3/043

USPC ..... 49/161, 162, 163, 168, 169, 176, 177, 49/197, 198, 199; 160/116, 180

See application file for complete search history.

(56) References Cited

U.S. PATENT DOCUMENTS

| | | | | |
|---|---|---|---|---|
| 3,614,974 | A * | 10/1971 | Tajima | 160/188 |
| 4,619,075 | A | 10/1986 | Wiles | |
| 5,402,841 | A | 4/1995 | Tierney | |

(Continued)

OTHER PUBLICATIONS

International Search Report and Written Opinion for PCT Application No. PCT/US2014/045555, dated Oct. 24, 2014, 11 pages.

(Continued)

*Primary Examiner* — Katherine Mitchell
*Assistant Examiner* — Catherine A Kelly
(74) *Attorney, Agent, or Firm* — Foley & Lardner LLP

(57) ABSTRACT

An access system for a temperature-controlled storage device includes a perimeter frame and least one display case door mounted within the perimeter frame. The perimeter frame and the at least one display case door are configured to move substantially vertically along a surface of the temperature-controlled storage device between a raised position and a lowered position. The at least one display case door is further configured to move substantially horizontally between an open position and a closed position when the perimeter frame is in the lowered position. The access system further includes a torsion spring and motor assembly coupled to the perimeter frame and configured to move the perimeter frame and the at least one display case door between the raised position and the lowered position.

20 Claims, 17 Drawing Sheets

(56) References Cited

U.S. PATENT DOCUMENTS

| | | | | |
|---|---|---|---|---|
| 7,497,072 | B2 * | 3/2009 | Hermey | 59/78.1 |
| 2008/0115416 | A1 * | 5/2008 | Clark | 49/142 |
| 2009/0241422 | A1 * | 10/2009 | Mock et al. | 49/197 |
| 2011/0041406 | A1 * | 2/2011 | Jimenez Del Amo et al. | 49/13 |
| 2011/0290431 | A1 | 12/2011 | Ehrlich | |
| 2012/0062080 | A1 | 3/2012 | Maslen | |
| 2012/0285089 | A1 | 11/2012 | Artwohl et al. | |
| 2013/0019616 | A1 | 1/2013 | Reichert | |

OTHER PUBLICATIONS

Jamison Door Company, "Freezer Door Furnished with Frostop Heater Cables", document dated May 23, 2011, 3 pages.
Jamison, Architect Data Sheet ADS-203, "Mark IV Overhead Manually Operated Door Standard Lift", 2 pages.
Jamison, Architect Data Sheet ADS-200B, "Mark IV Single Leaf Horizontal Sliding Power Operated Door", document dated Oct. 5, 2010, 5 pages.
Jamison, Architect Data Sheet ADS-202, "Mark IV Vertical Sliding Manually Operated Door", 1 page.
Jamison, Architect Data Sheet ADS-201, "Mark IV Single Leaf Horizontal Sliding Manually Operated Door", 1 page.
Frank Door Company, "Vertical Lift Cold Storage Door", document dated 2011, 2 pages.
Frank Door Company, "Manual Vertical with Torsion Spring", 1 page.
Frank Door Company, "Electric Droptrac Biparting Sliding", 1 page.
Frank Door Company, "Installation Instructions for Vertical Lift with Torsion Springs", 10 pages.
DAN-doors, "Vertical Sliding Doors—For Chill Rooms", 2 pages.
Enviro Cold Storage Doors, "Model XP 2500 Single Sliding Cooler/Freezer Door System", document dated Jun. 17, 2010, 2 pages.
Enviro Cold Storage Doors, Data Sheet Model 507, "Single Piece Vertical Rise Door", document dated Jun. 2009, 2 pages.
Enviro Cold Storage Doors, "Enviro Model 507 Fiberglass Single Piece Vertical Rise Door", http://www.envirodoors.com/arch_specs.php?dID=82, date accessed: Jan. 5, 2012, 2 pages.
Custom Cooler Inc., "Installation Instructions", http://www.customcooler.com/installation.html, date accessed: Jan. 23, 2012, 2 pages.
Custom Cooler Inc., Drawing No. 09113774-D, document dated Jan. 13, 2010, 1 page.
Chase Doors, "ColdGuard Vertical Lift Cold Storage Doors", http://www.coldstoragedoorsonline.com/printerfriendlyasp?id=68, date accessed: Jan. 5, 2012, 1 page.
Weiland, "Power Vertical Slide Door with Torsion Spring", 1 page.
ZAP Controls, "8825 Series 3 Super-Drive Torsion Shaft Mounted DC Commercial Sectional Door Operator", 2 pages.
ZAP Controls, "Plug-In Dock Traffic Light: Warning Module Zap Model No. 822", 1 page.
ZAP Controls, "Motor Control Unit Installation Instructions", document dated Dec. 8, 2010, 13 pages.
Linear Corp., "MegaCode Series MDR, MDR2, MDRNR, MDRM, MDRM2 Digital Receivers Installation Instructions", document dated 1999, 2 pages.
Gentex Corporation, "Visible and/or Audible Signaling Appliances", document dated Feb. 1, 2010, 4 pages.
Igus, "E2 Micro Igus' Smallest Energy Chain Cable Carrier", 30 pages.
Kysor Panel Systems, "Structural-Frame Panel", 1 page.

* cited by examiner

ACCESS SYSTEM FOR A TEMPERATURE CONTROLLED STORAGE DEVICE

FIELD

The present disclosure relates generally to the field of temperature-controlled storage devices such as refrigerated display cases as may be found in a supermarket or other similar facility. The present disclosure relates more particularly to a space-efficient access system for a temperature-controlled storage device. The present disclosure relates more particularly still to an improved access system for a temperature-controlled storage device, the access system having both a vertically-movable frame and a horizontally-rotatable door mounted within the vertically-movable frame for providing versatile access to the temperature-controlled storage device.

BACKGROUND

This section is intended to provide a background or context to the invention recited in the claims. The description herein may include concepts that could be pursued, but are not necessarily ones that have been previously conceived or pursued. Therefore, unless otherwise indicated herein, what is described in this section is not prior art to the description and claims in this application and is not admitted to be prior art by inclusion in this section.

It is generally known to provide temperature-controlled storage devices (e.g., a refrigerator, freezer, refrigerated merchandiser, display case, etc.) that may be used in commercial, institutional, and residential applications for storing or displaying refrigerated or frozen objects. It is also generally known to provide access to temperature-controlled storage devices (e.g., via a door or entry panel) such that refrigerated or frozen objects may be placed into the temperature-controlled display case (e.g., by a merchant) and subsequently removed from the temperature-controlled display case (e.g., by a consumer).

Traditional systems for accessing objects in a temperature-controlled display device are often space-inefficient and/or difficult to access. For example, traditional access systems often include a large entry door which may be accessed by a merchant for placing a large quantity of objects in the temperature-controlled display device simultaneously (e.g., using a fork lift, a pallet jack, etc.) and a plurality of smaller doors which may be accessed by a consumer for removing relatively smaller quantities of objects from the temperature-controlled display device (e.g., removing a single object while shopping). The smaller doors are often too small to receive a pallet of merchandise and cannot efficiently be used to stock the temperature-controlled display device. It is often necessary to provide a path from the large entry door to each of the plurality of smaller doors within the temperature-controlled display device such that the merchant can restock any of the objects from the rear without first removing other objects. The path must remain empty and therefore results in an inefficient use of space within the temperature-controlled display device. It would be desirable to provide an improved access system for a temperature-controlled display device which makes efficient use of space and facilitates easy access of both large and small quantities of objects.

SUMMARY

One implementation of the present disclosure is an access system for a temperature-controlled storage device. The access system includes a perimeter frame configured to move substantially vertically along a surface of the temperature-controlled storage device between a raised position and a lowered position. The access system further includes at least one display case door mounted within the perimeter frame and configured to move along with the perimeter frame between the raised position and the lowered position. The at least one display case door is configured to move substantially horizontally between an open position and a closed position when the perimeter frame is in the lowered position. The access system further includes a torsion spring assembly coupled to the perimeter frame and configured to counteract a weight of the perimeter frame and the at least one display case door. The torsion spring assembly is configured to store energy when the perimeter frame and the at least one display case door are moved into the lowered position and to release the stored energy when the perimeter frame and the at least one display case door are moved into the raised position.

Another implementation of the present disclosure is another access system for a temperature-controlled storage device. The access system includes a display case door assembly including an interior frame and a display case door mounted within the interior frame. The display case door is configured to rotate about a substantially vertical axis of rotation between an open position and a closed position. The access system further includes a perimeter frame fixedly attached to the interior frame along an outer perimeter of the interior frame. The perimeter frame is configured to move substantially vertically between a raised position in which the perimeter frame uncovers an opening in the temperature-controlled display device and a lowered position in which the perimeter frame covers the opening in the temperature-controlled display device. The access system further includes a torsion spring and motor assembly coupled to the perimeter frame and configured to move the perimeter frame and display case door assembly between the raised position and the lowered position. The access system further includes a controller configured to operate the torsion spring and motor assembly to move the perimeter frame and display case door assembly between the raised position and the lowered position.

Another implementation of the present disclosure is yet another access system for a temperature-controlled storage device. The access system includes one or more guide channels fixed to an exterior surface of the temperature-controlled storage device and extending substantially vertically adjacent to an opening in the temperature-controlled storage device. The access system further includes a perimeter frame configured to move substantially vertically along a path defined by the one or more guide channels between a raised position in which the perimeter frame uncovers the opening in the temperature-controlled storage device and a lowered position in which the perimeter frame covers the opening in the temperature-controlled storage device. The access system further includes at least one display case door mounted within the perimeter frame and configured to move along with the perimeter frame between the raised position and the lowered position. The at least one display case door is further configured to rotate about a substantially vertical axis of rotation coplanar with the perimeter frame between a closed position in which the at least one display case door prevents access to the temperature-controlled storage device and an open position in which the at least one display case door allows access to the temperature-controlled storage device through a portion of the perimeter frame.

Those skilled in the art will appreciate that the summary is illustrative only and is not intended to be in any way limiting. Other aspects, inventive features, and advantages of the devices and/or processes described herein, as defined solely by the claims, will become apparent in the detailed description set forth herein and taken in conjunction with the accompanying drawings.

DETAILED DESCRIPTION

Referring generally to the FIGURES, an improved access system for a temperature-controlled storage device and components thereof are shown, according to various exemplary embodiments. A temperature-controlled storage device may include a refrigerator, freezer, refrigerated merchandiser, display case, or other temperature-controlled devices that may be used in commercial, institutional, and residential applications for storing or displaying refrigerated or frozen objects. For example, the access system described herein can be used to provide versatile and space-efficient access to a refrigerated display case in a supermarket.

The access system of the present disclosure includes at least one display case door mounted within a perimeter frame. The display case doors can be opened and closed in a traditional manner by rotating or pivoting the doors about a substantially vertical axis (e.g., via an attached handle) coplanar with the perimeter frame. The perimeter frame can be moved substantially vertically between a raised position and a lowered position to uncover and cover an opening in a side of the refrigerated display case. Because the display case doors are mounted within the perimeter frame, the display case doors move vertically along with the perimeter frame.

When the perimeter frame and display case doors are in the lowered position, the display case doors can be opened and closed in a traditional manner for providing consumer access to the items stored within the refrigerated display case. When the perimeter frame and display case doors are moved into the raised position, a relatively larger opening in the side of the refrigerated display case is exposed (e.g., larger than an opening provided by a single display case door), thereby facilitating easy access for bulk restocking. Advantageously, a merchant can raise the perimeter frame and restock the refrigerated display case (e.g., using a fork lift, a pallet jack, etc.) through the same opening used by consumers to access the items stored therein. This advantage eliminates the need for a separate larger door for bulk restocking and allows the space within the refrigerated display case to be used more efficiently (e.g., by reducing or eliminating the need for empty space within the refrigerated display case).

Figure 1:
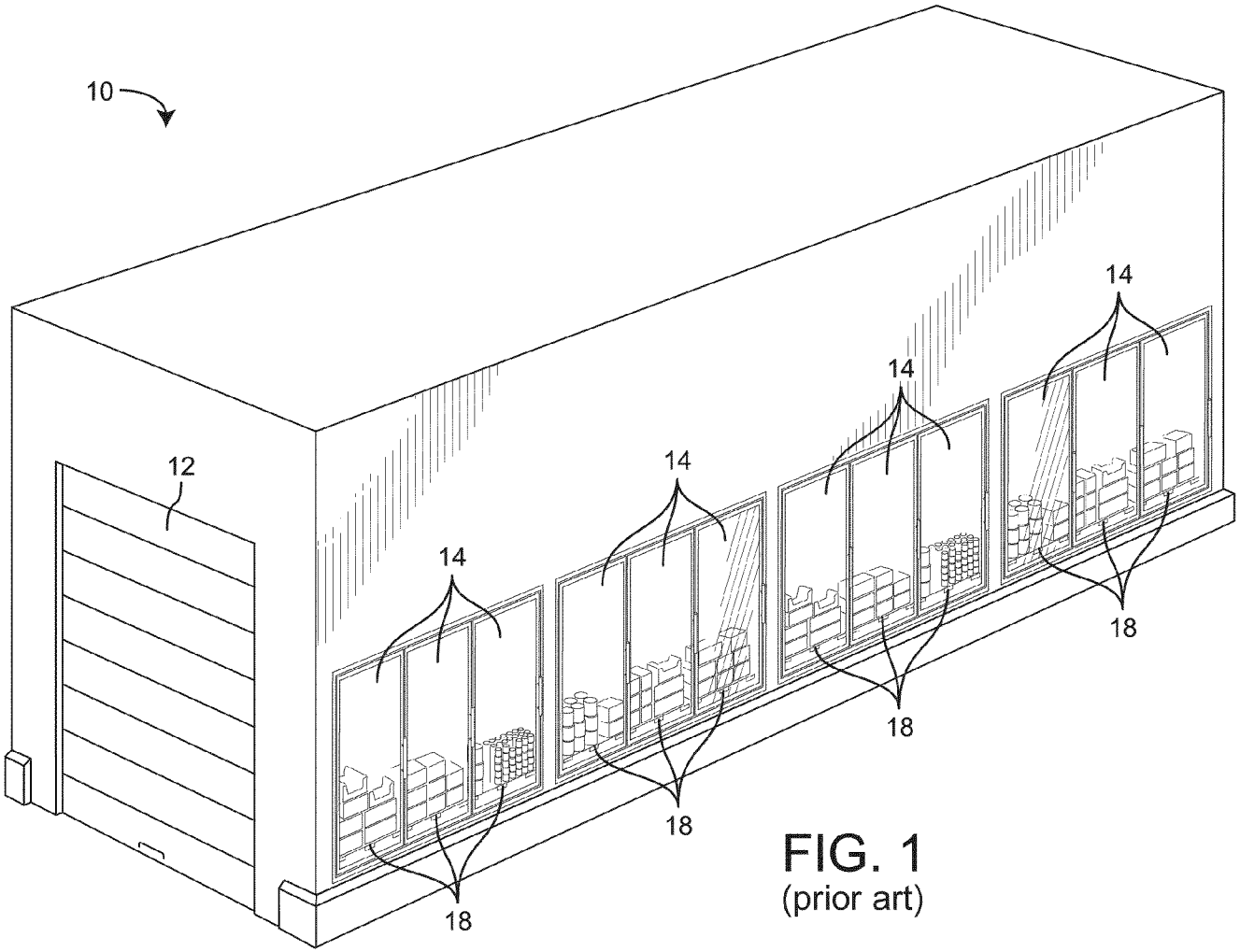
FIG. 1 (prior art)
FIG. 1 is a drawing of a traditional temperature-controlled storage device including a plurality of display case doors and a separate large entry door, according to an exemplary embodiment.

Referring now to FIG. 1, a traditional temperature-controlled storage device 10 is shown, according to an exemplary embodiment. Temperature-controlled storage device 10 is shown as a refrigerated display isle in a supermarket setting. Temperature-controlled storage device 10 includes a large entry door 12 at an end of the isle and a plurality of smaller display case doors 14 along a side of the isle. Large entry door 12 may be used by a merchant for restocking the items stored within temperature-controlled storage device 10. Display case doors 14 may be used by consumers for accessing individual items within temperature-controlled storage device 10 (e.g., while shopping).

Because display case doors 14 are typically smaller than large entry door 12, it is often inefficient or impossible to restock temperature-controlled storage device 10 using display case doors 14. For example, the items within temperature-controlled storage device 10 may be transported, stored, and displayed on pallets 18 which are physically too large to fit through display case doors 14. Therefore, it is often necessary to use large entry door 12 for stocking pallets of items within temperature-controlled storage device 10.

Figure 2:
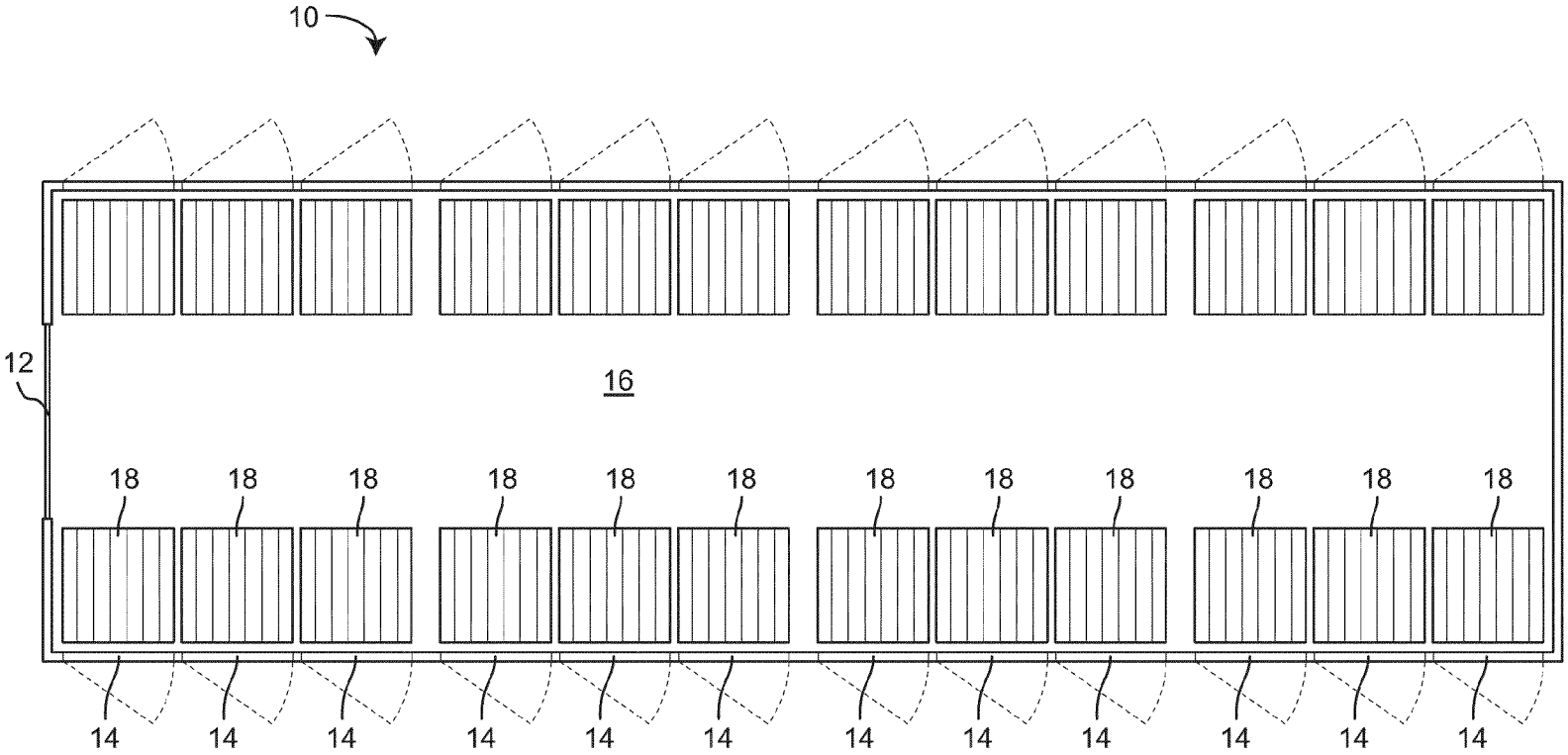
FIG. 2 (prior art)
FIG. 2 is a plan view of the traditional temperature-controlled storage device of FIG. 1, illustrating an inefficient use of space within the traditional temperature-controlled storage device, according to an exemplary embodiment.

Referring now to FIG. 2, a plan view of temperature-controlled storage device 10 is shown, according to an exemplary embodiment. Traditionally, a merchant would restock temperature-controlled storage device 10 by opening large entry door 12 and transporting pallets 18 (e.g., using a fork truck, a pallet jack, etc.) to the desired display location behind display case doors 14. It is often necessary to provide a path 16 from large entry door 12 to each of the plurality of display case doors 14 (e.g., inside temperature-controlled display device 10) to allow any of pallets 18 to be replaced or restocked without first removing or rearranging other pallets 18. Path 16 generally must remain empty and therefore results in an inefficient use of space within temperature-controlled display device 10.

Figure 3:
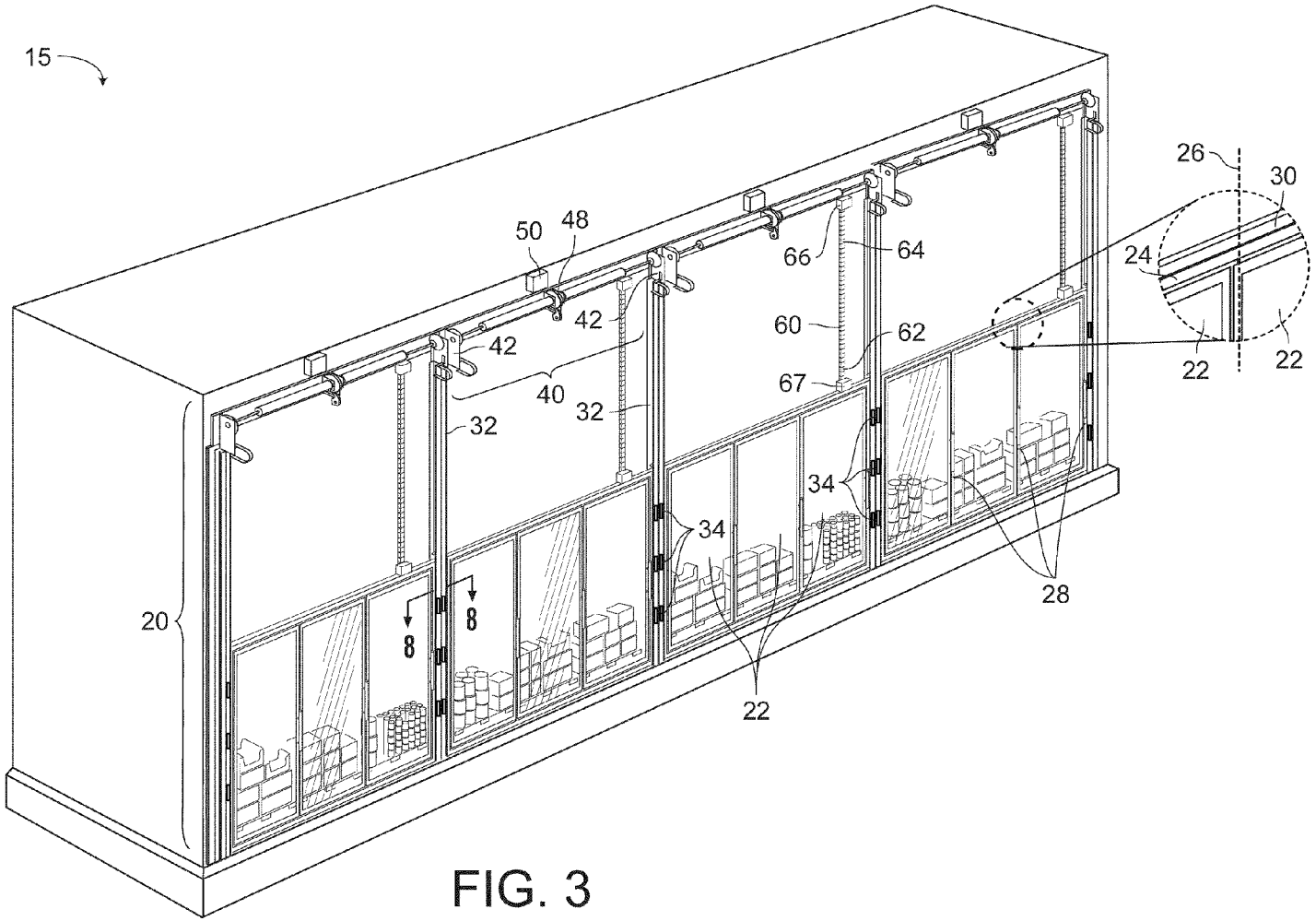
FIG. 3 is a drawing of a temperature-controlled storage device outfitted with an improved access system including a plurality of display case doors mounted within a vertically-movable perimeter frame, showing the display case doors and the perimeter frame in a lowered position, according to an exemplary embodiment.

Referring now to FIG. 3, a temperature-controlled storage device 15 outfitted with an improved access system 20 is shown, according to an exemplary embodiment. Access system 20 may be implemented to provide efficient and versatile access to a refrigerator, freezer, refrigerated merchandiser, display case, or other temperature-controlled devices that may be used in commercial, institutional, and residential applications for storing or displaying refrigerated or frozen objects. In some embodiments, access system 20 may be used to provide access to a refrigerated display case in a supermarket, a warehouse store, a retail store, or other similar location.

Access system 20 is shown to include a plurality of display case doors 22. Display case doors 22 may be transparent or substantially transparent doors configured to facilitate presentation of refrigerated or frozen goods stored within temperature-controlled storage device 15. Display case doors 22 may be insulated and/or constructed from insulating materials to reduce heat transfer through display case doors 22. For example, display case doors 22 may be constructed from tempered safety glass and may include insulated, energy-efficient frames around the tempered safety glass. Display case doors 22 may include magnetic door gaskets to ensure an airtight seal when display case doors 22 are closed.

In some embodiments, display case doors 22 include an electronic component. For example, display case doors 22 may include electronic door locks (e.g., electromagnetic or electromechanical door locks), electric heating elements (e.g., for anti-condensate control), lighting strips (e.g., LED lighting for improved presentation and display of items within the refrigerated display case), and/or other electric or electronic components as may be desirable for a particular implementation. Display case doors 22 may include wiring or other electric conduits for receiving power (e.g., electric current, voltage, etc.) and/or electronic data communications (e.g., control signals) from other components of access system 20.

Display case doors 22 may be mounted within an interior frame 24. In some embodiments, a plurality of display case doors 22 (e.g., two, three, four, etc.) may be mounted within a single interior frame 24. Display case doors 22 may be rotatable about substantially vertical axes of rotation 26 (e.g., by manipulating handles 28). In some embodiments, axes of rotation 26 may be coplanar or substantially coplanar with interior frame 24. Display case doors 22 may be rotatable about axes 26 between a closed position and an open position. Display case doors 22 may be configured to automatically close when released from the open position and may be adjusted to set a desired closing tension and/or torque. When display case doors 22 are in the closed position, display case doors 22 may be coplanar or substantially coplanar with interior frame 24 and may prevent access to temperature-controlled storage device 15. When display case doors 22 are in the open position, display case doors 22 may allow access to temperature-controlled storage device 15 by exposing an opening in a side thereof. The opening in the side of temperature-controlled storage device 15 may be a single opening approximately the same size as interior frame 24.

Still referring to FIG. 3, access system 20 is shown to further include a perimeter frame 30. Perimeter frame 30 may form a perimeter around interior frame 24 and may be substantially coplanar with and fixedly attached to interior frame 24. Perimeter frame 30 may be configured to move substantially vertically between a lowered position (e.g., shown in FIG. 3) and a raised position (e.g., shown in FIG. 4). In some embodiments, perimeter frame 30 is configured to slide along one or more guide channels 32 defining a substantially vertical path between the lowered position and the raised position. Guide channels 32 may be fixed to an exterior surface of temperature-controlled storage device 15 adjacent to the opening extending therethrough. Guide channels 32 are described in greater detail with reference to FIG. 6.

Perimeter frame 30 may be linked (e.g., fixedly attached, non-fixedly attached, etc.) to one or more sliding guide elements 34. Sliding guide elements 34 may restrict the linear movement and/or rotation of perimeter frame 30 relative to guide channels 32, thereby allowing only substantially vertical movement of perimeter frame 30. In some embodiments, sliding guide elements 34 are fixed to an exterior side surface of perimeter frame 30 and slide along guide channels 32. In other embodiments, sliding guide elements are fixed to guide channels 32 and slide along an exterior side surface of perimeter frame 30. Perimeter frame 30 is described in greater detail with reference to FIG. 7.

Still referring to FIG. 3, access system 20 is shown to include a torsion spring and motor assembly 40. Torsion spring and motor assembly 40 may be mounted (e.g., attached, fixed, installed, located, etc.) along an exterior side surface of temperature-controlled storage device 15 (e.g., via mounting brackets 42) above the opening extending therethrough. Torsion spring and motor assembly 40 may be coupled to perimeter frame 30 (e.g., via a cable extending from torsion spring and motor assembly 40 to perimeter frame 30) and may be used to facilitate movement of perimeter frame 30 between the lowered position and the raised position. For example, when perimeter frame 30 is moved into the lowered position, torsion spring and motor assembly 40 may store energy (e.g., by twisting and/or compressing a torsion spring). When perimeter frame 30 is moved into the raised position, the stored energy may be released to counteract the weight of perimeter frame 30 and display case doors 22, thereby reducing the external energy required to effect movement into the raised position.

In some embodiments, torsion spring and motor assembly 40 includes a motor 48. Motor 48 may be configured to apply a torque to torsion spring and motor assembly 40. Torsion spring and motor assembly 40 may translate the applied torque into a tension in the cable linking torsion spring and motor assembly 40 to perimeter frame 30, thereby causing movement of perimeter frame 30 and display case doors 22 between the raised position and the lowered position. Torsion spring and motor assembly 40 is described in greater detail with reference to FIGS. 9-11.

Still referring to FIG. 3, access system 20 is shown to include a controller 50 and a cable guide 60. Controller 50 may be configured to operate motor 48 (e.g., by providing a control signal to motor 48, by supplying power to motor 48, etc.) to cause movement of perimeter frame 30 and display case doors 22 between the raised position and the lowered position. In some embodiments, controller 50 is configured to receive input from a remote control device, thereby allowing remote operation of access system 20. Controller 50 may be configured to provide control signals to display case doors 22 to operate an electronic component thereof (e.g., an electronic door lock, a heating element, a lighting element, etc.). Controller 50 is described in greater detail with reference to FIG. 14.

Cable guide 60 may have a first end 62 attached to perimeter frame 30 and a second end 64 attached to a fixed mounting bracket 66. In some embodiments, first end 62 may attach to a junction box 67 mounted on perimeter frame 30. First end 62 may be movable along with perimeter frame 30 between the raised position and the lowered position. Cable guide 60 may be configured to bend in a predictable manner when perimeter frame 30 is moved between the raised position and the lowered position. Cable guide 60 may provide a flexible and protected path for power cables, signal cables, or other electric conduits used to supply power and/or communicate control signals to display case doors 22. Cable guide 60 is described in greater detail with reference to FIG. 12.

Figure 4:
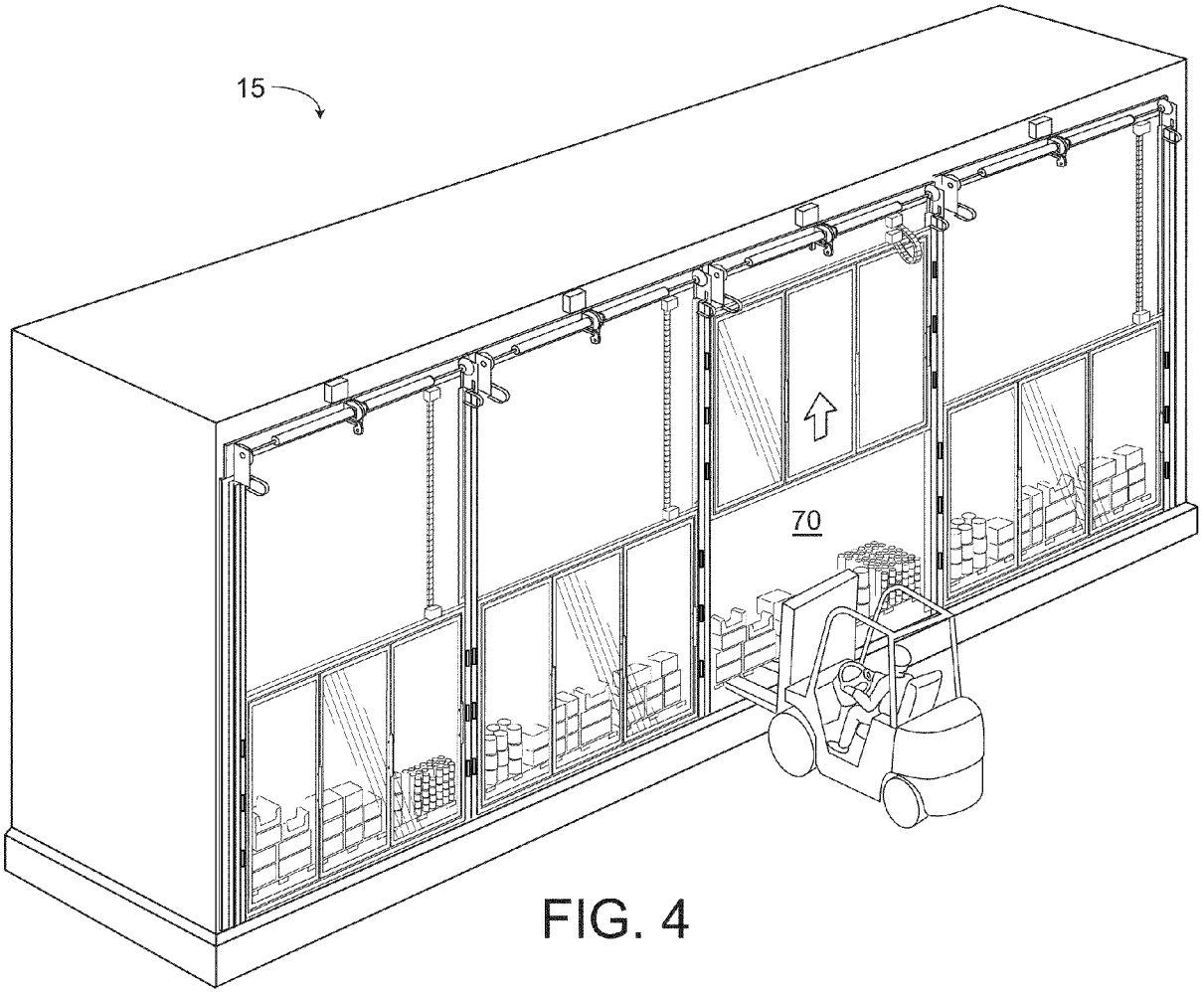
FIG. 4 is a drawing of a temperature-controlled storage device outfitted with the improved access system of FIG. 3, showing the display case doors and the perimeter frame in a raised position, according to an exemplary embodiment.

Referring now to FIG. 4, access system 20 is shown with perimeter frame 30 in the raised position, according to an exemplary embodiment. Because interior frame 24 and display case doors 22 are vertically fixed to perimeter frame 30, both interior frame 24 and display case doors 22 move along with perimeter frame 30 into the raised position. When perimeter frame 30 is in the raised position, a large opening 70 extending through a side of temperature-controlled storage device 15 may be exposed. Opening 70 may have a size approximately equal to the size of perimeter frame 30 and/or interior frame 24. Opening 70 may be significantly larger (e.g., twice as large, three times as large, etc.) as any of display case doors 22, depending on the number of display case doors 22 mounted within interior frame 24. For example, opening 70 may be approximately three times as large as display case doors 22 if three display case doors are mounted within interior frame 24 (e.g., as shown in FIGS. 3-4).

Advantageously, the relatively large size of opening 70 may facilitate versatile and space-efficient use of temperature-controlled storage device 15. For example, access system 20 allows the refrigerated or frozen items within temperature-controlled storage device 15 to be restocked from the front (e.g., through opening 70) rather than from the rear (e.g., from within temperature-controlled storage device 15). As shown in FIG. 4, opening 70 may be large enough to receive one or more entire pallets of items (e.g., via a fork lift, a pallet jack, etc.) from the front of the refrigerated display case. Opening 70 can be used by a merchant to quickly and easily restock large quantities of items (e.g., with perimeter frame 30 in the raised position) and by a consumer to select relatively smaller quantities of items for purchase (e.g., via display case doors 22 when perimeter frame 30 is in the lowered position).

Figure 5:
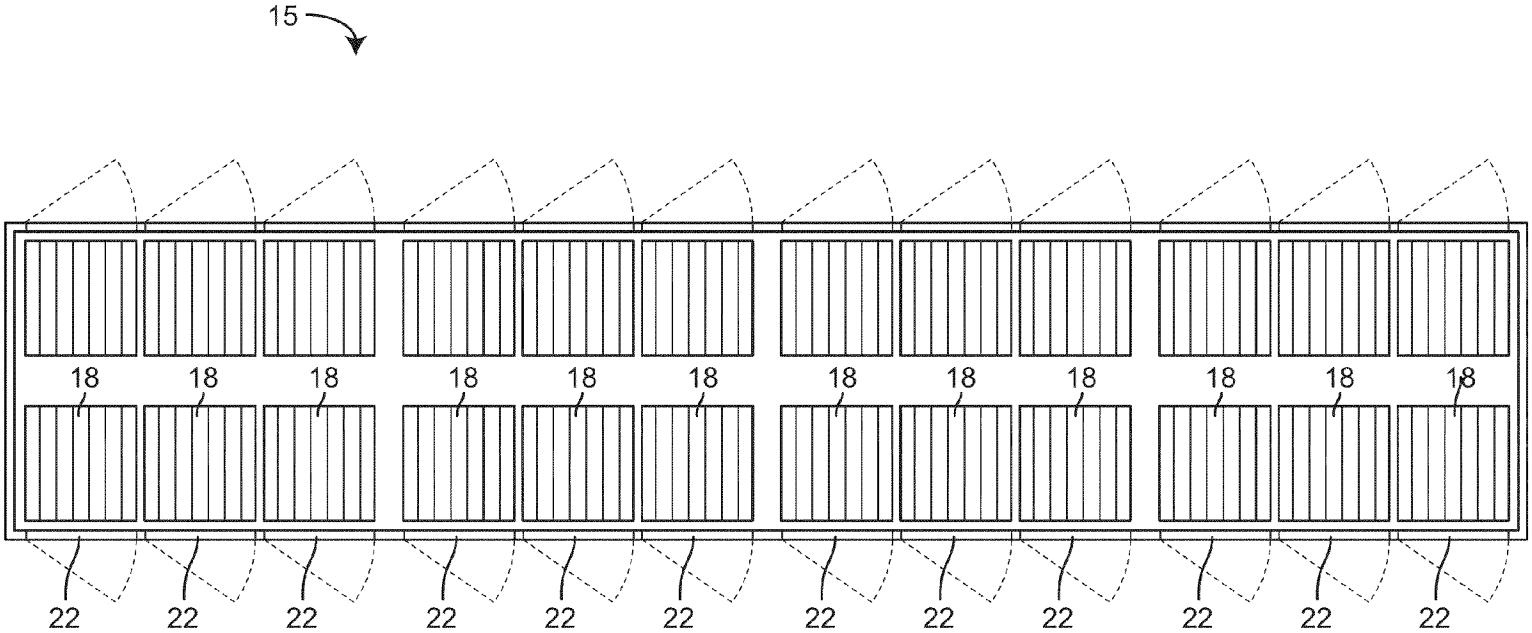
FIG. 5 is a plan view of the temperature-controlled storage device outfitted with the improved access system of FIG. 3, illustrating an efficient use of space within the temperature-controlled storage device made possible by the improved access system, according to an exemplary embodiment.

Referring now to FIG. 5, a plan view of temperature-controlled storage device 15 is shown, according to an exemplary embodiment. FIG. 5 illustrates a refrigerated display case outfitted with improved access system 20 rather than a traditional access system (e.g., as shown in FIGS. 1-2). Temperature-controlled storage device 15 is shown to include a plurality of display case doors 22 and several pallets 18 stocked behind display case doors 22. The relatively large size of opening 70 may allow pallets 18 to be loaded into temperature-controlled storage device 15 from the front without requiring another door or access point (e.g., such as large entry door 12 shown in FIGS. 1-2).

Additionally, loading temperature-controlled storage device 15 from the front eliminates the need to provide a path (e.g., such as path 16 shown in FIG. 2) within temperature-controlled storage device 15 to each of pallets 18. By eliminating path 16, the amount of unusable empty space within temperature-controlled storage device 15 can be reduced relative to temperature-controlled storage device 10. Reducing the amount of empty space within temperature-controlled storage device 15 may allow temperature-controlled storage device 15 to be narrowed to make more efficient use of floor space within the facility in which temperature-controlled storage device 15 is implemented.

Figure 6:
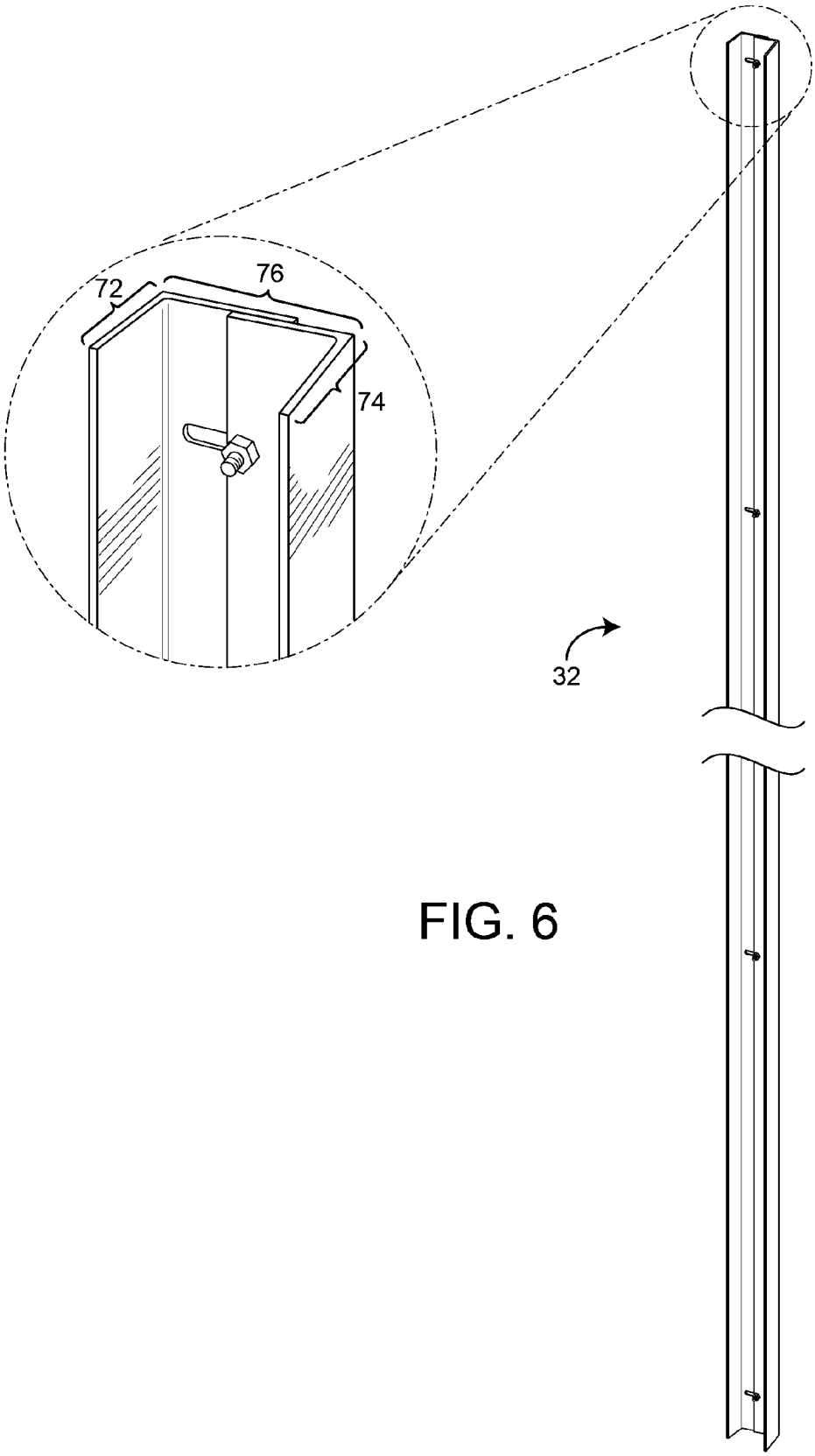
FIG. 6 is a drawing of a guide channel which may be used to guide movement of the perimeter frame and display case doors between the raised position and the lowered position, according to an exemplary embodiment.

Referring now to FIGS. 6-14, several components of improved access system 20 are shown in greater detail, according to an exemplary embodiment. Referring specifically to FIG. 6, a detailed drawing of guide channel 32 is shown, according to an exemplary embodiment. Guide channel 32 may be a "U channel" or "C channel" having a first side 72, a second side 74, and a middle section 76. In some embodiments, guide channel 32 may be an open rectangular or substantially rectangular channel such that first side 72 and second side 74 are parallel or substantially parallel and a middle section 76 is perpendicular or substantially perpendicular to both first side 72 and second side 74. Guide channel 32 may be a generally linear channel as may be formed by a die extrusion process. In some embodiments, guide channel 32 has a length approximately equal to twice the height of opening 70.

Guide channel 32 may be fixed (e.g., mounted, installed, attached, etc.) to an exterior surface of temperature-controlled storage device 15 adjacent to opening 70. In some embodiments, guide channel 32 is oriented vertically or substantially vertically adjacent to a side of opening 70. For example, a bottom end of guide channel 32 may be located near a bottom corner of opening 70. Guide channel 32 may extend upward parallel to a side of opening 70 and continue beyond an upper corner of opening 70. An upper end of guide channel 32 may be located at a height approximately twice the height of opening 70.

In some embodiments, multiple guide channels 32 may be used. For example, two guide channels 32 may be mounted adjacent to opposing sides of opening 70. In some embodiments, each perimeter frame 30 is guided by a pair of guide channels 32. A first guide channel 32 may guide a first side (e.g., the left side) of perimeter frame 30 and a second guide channel 32 may guide a second side (e.g., the right side) of perimeter frame 30.

Guide channels 32 may be fastened to the exterior surface of temperature-controlled storage device 15 such that one of first side 72 and second side 74 is parallel to the fastening surface. Guide channels 32 may be oriented relative to opening 70 such that the open section of guide channels 32 (e.g., opposite middle section 76) is oriented inward toward opening 70. For implementations in which multiple guide channels 32 are used, a pair of guide channels mounted on opposing sides of opening 70 may arranged in a mirrored configuration such that both guide channels 32 have an open section facing inward toward opening 70.

In some embodiments, guide channels 32 may be installed in a "back-to-back" configuration. For example, for implementations in which many display case doors 22 are arranged in a row (e.g., along an extended refrigerated display isle), guide channels 32 may be installed back-to-back (e.g., directly adjacent and mirrored) between groupings of display case doors 22. In other words, middle section 76 of a first guide channel 32 may be arranged in parallel abutment with a middle section 76 of another guide channel 32. In the back-to-back configuration, pairs of abutting guide channels 32 may be configured to guide separate perimeter frames 30.

In some embodiments, guide channels 32 extend vertically upward from a floor surface toward torsion spring and motor assembly 40. In other embodiments, guide channels 32 do not extend entirely to the floor or entirely to torsion spring and motor assembly 40. For example guide channels 32 may extend only throughout the distance required to effectively guide perimeter frame 30 between the raised position and the lowered position (e.g., the length required by sliding guide elements 34, etc.). In some embodiments, guide channels 32 have a length approximately equal to twice the height of opening 70.

Figure 7:
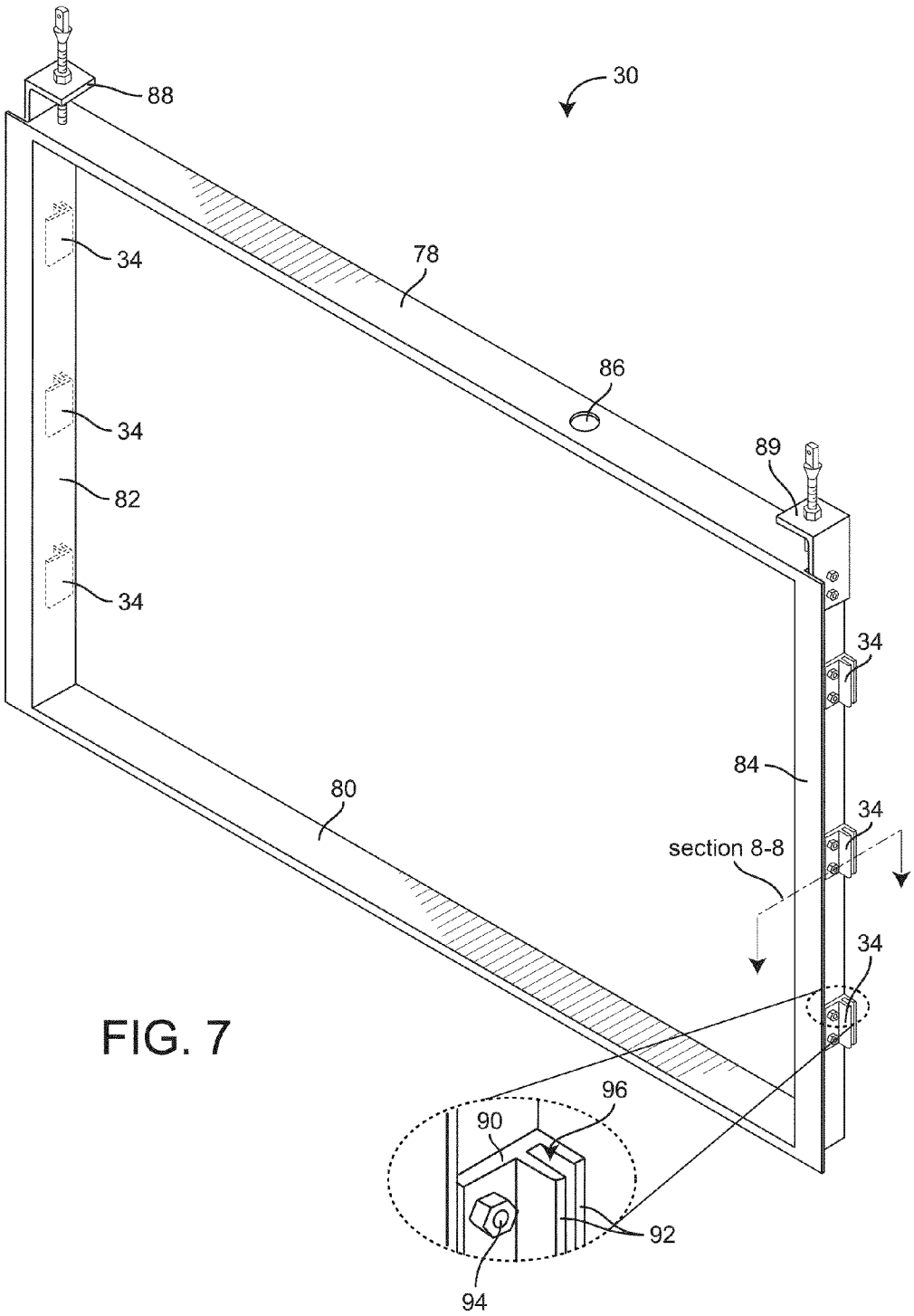
FIG. 7 is a drawing illustrating the perimeter frame of FIG. 3 in greater detail, according to an exemplary embodiment.

Referring now to FIG. 7, a drawing illustrating perimeter frame 30 in greater detail is shown, according to an exemplary embodiment. Perimeter frame 30 may be a rectangular or substantially rectangular frame formed from multiple segments of an extruded rectangular channel. For example, perimeter frame is shown to include a top segment 78, a bottom segment 80, and side segments 82 and 84. Top segment 78 and bottom segment 80 may be parallel or substantially parallel and side segments 82 and 84 may be parallel or substantially parallel. Side segments 82 and 84 may be perpendicular or substantially perpendicular to both top segment 78 and bottom segment 80. In some embodiments, segments 78-84 are hollow rectangular channels. Bottom segment 80 may be configured to engage a floor surface or a raised sill when perimeter frame 30 is moved into the lowered position (e.g., shown in FIG. 3). In some embodiments, perimeter frame 30 is a tubular frame and segments 78-84 are hollow tubular channels. Perimeter frame 30 may be manufactured from aluminum, steel, stainless steel, other metallic or non-metallic materials (e.g., polymers, ceramics, etc.), or any combination thereof.

In some embodiments, perimeter frame 30 includes an opening 86 extending through top segment 78. Opening 86 may be configured to receive an electrical conduit for providing an electrical connection through perimeter frame 30 to display case doors 22. In some embodiments opening 86 extends vertically through a top and bottom surface of top segment 78. In some embodiments, the electrical conduit passes through opening 86 substantially vertically. In other embodiments, the electrical conduit travels horizontally within top segment 78 between an entry opening on a top surface of segment 78 and an exit opening on a bottom surface of segment 78.

Still referring to FIG. 7, perimeter frame 30 may be fixedly attached to one or more coupling brackets 88-89. Coupling brackets 88-89 may facilitate a connection between perimeter frame 30 and torsion spring and motor assembly 40. For example, coupling brackets 88-89 may be fastened (e.g., via a bolt, screw, or other fastener) to perimeter frame 30 and may be configured to receive a tension cable extending from torsion spring and motor assembly 40. Torsion spring and motor assembly 40 may cause movement of perimeter frame 30 by adjusting a length of the tension cable. In some embodiments, coupling brackets 88-89 may interface with an intermediate element between coupling bracket 88 and the tension cable. Coupling brackets 88-89 may be "L brackets" having a ninety degree bend between a first and second end thereof.

In some embodiments, multiple coupling brackets 88-89 are used. For example, a first coupling bracket 88 may be affixed to side segment 82 and a second coupling bracket 89 may be affixed to side segment 84. Coupling brackets 88-89 may be fastened to side segments 82 and 84 near the top corners of perimeter frame 30 (e.g., near the intersections of side segments 82 and 84 with top segment 78) such that a portion of coupling brackets 88-89 extends horizontally above top segment 78. Coupling bracket 88 may be configured to receive a first tension cable extending from torsion spring and motor assembly 40 and coupling bracket 89 may be configured to receive a second tension cable extending from torsion spring and motor assembly 40.

Still referring to FIG. 7, perimeter frame 30 may be linked (e.g., fixedly attached, non-fixedly attached, etc.) to one or more sliding guide elements 34. Sliding guide elements 34 may restrict the linear movement and/or rotation of perimeter frame 30 relative to guide channels 32, thereby allowing only substantially vertical movement of perimeter frame 30. Perimeter frame 30 may be configured to slide along guide channels 32 between the lowered position and the raised position along a path defined by guide channels 32. In some embodiments, sliding guide elements 34 are fixed to side segments 82 and 84 and are configured to slide along guide channels 32. In other embodiments, sliding guide elements 34 are fixed to guide channels 32 and are configured to slide along side segments 82 and 84.

Sliding guide elements 34 are shown to include a base portion 90 and a pair of protrusions 92. Base portion 90 may be a substantially flat plate (e.g., a thin rectangular plate, a thin disc, etc.) and may include one or more holes extending therethrough. The holes may be configured to receive a fastener 94 (e.g., a bolt, a screw, a peg, etc.) for fastening sliding guide element 34 to perimeter frame 30. Protrusions 92 may be arranged in close proximity to each other and may extend along a length of sliding guide element 34. Protrusions 92 may define a channel 96 extending therebetween along a length of sliding guide element 34. In some embodiments, channel 96 is a "V-shaped" channel.

Figure 8:
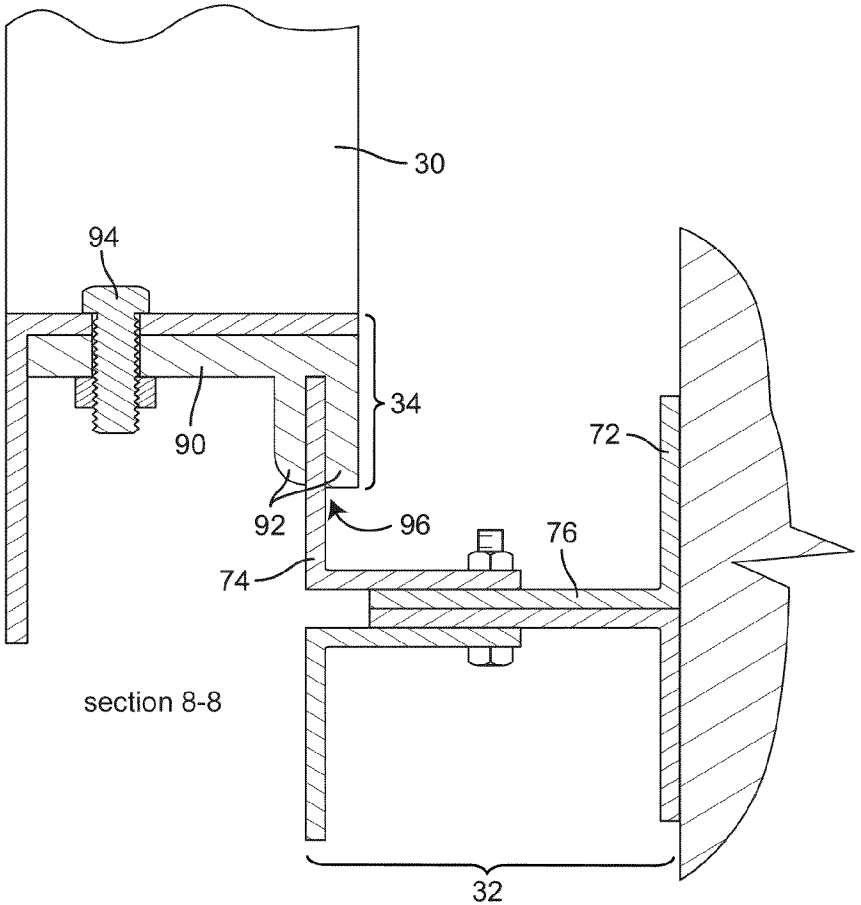
FIG. 8 is a cross-sectional view of a sliding linkage between the perimeter frame and the guide channel, according to an exemplary embodiment.

Referring now to FIG. 8, a cross-sectional view of a sliding link between perimeter frame 30 and a guide channel 32 is shown, according to an exemplary embodiment. FIG. 8 illustrates a horizontal cross section 8-8 taken at a location of a sliding guide element 34 as indicated in FIG. 7. In some embodiments, base portion 90 of sliding guide element 34 may be aligned with an outward-facing surface of side segment 82 or side segment 84 such that protrusions 92 extend horizontally away from perimeter frame 30. A fastener 94 may be inserted through the holes in base portion 90 to fixedly attach sliding guide element 34 to side segment 82 or 84.

Channel 96 of sliding guide element 34 may be configured to receive a side 72 or 74 of guide channel 32. When side 72 or 74 is received in channel 96, sliding guide element 34 may be restricted from moving horizontally relative to guide channel 32. However, sliding guide element 34 may be permitted to slide vertically along guide channel 32. By fixedly attaching to perimeter frame 30 and sliding vertically along guide channel 32, sliding guide element 34 may guide the movement of perimeter frame 30 along the substantially vertical path defined by guide element 32.

Figure 9A:
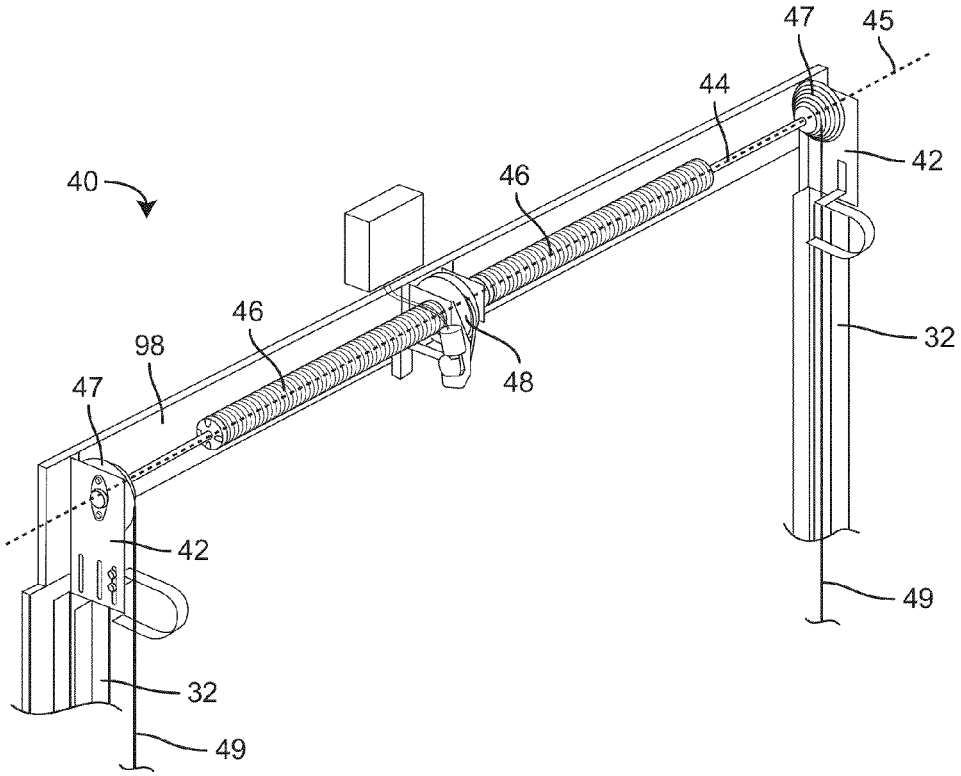
FIG. 9A is a drawing of a torsion spring and motor assembly which may be used to move the perimeter frame and the display case doors between the raised position and the lowered position, showing a frustoconical cable reel, according to an exemplary embodiment.

Referring now to FIG. 9A, a perspective view of torsion spring and motor assembly 40 is shown, according to an exemplary embodiment. Torsion spring and motor assembly 40 may be mounted (e.g., attached, fixed, installed, located, etc.) along an exterior side surface of temperature-controlled storage device 15 above opening 70. In some embodiments, torsion spring and motor assembly 40 may be attached directly to temperature-controlled storage device 15. In other embodiments, torsion spring and motor assembly 40 may be mounted to a top casing 98 which is attached to temperature-controlled storage device 15. Top casing 98 may have a width approximately equal to the width of opening 70 and may extend horizontally above guide channels 32 (e.g., at a height approximately twice the height of opening 70).

Torsion spring and motor assembly 40 is shown to include a pair of mounting brackets 42. Mounting brackets 42 may be attached to an exterior side surface of temperature-controlled storage device 15 or to top casing 98 (e.g., for embodiments in which top casing 98 is used). Mounting brackets 42 may be located above the top ends of guide channels 32 at a height approximately twice the height of opening 70. Mounting brackets 42 may be separated by a horizontal distance approximately equal to the width of opening 70. Mounting brackets 42 may extend outward substantially perpendicular to the side surface of temperature-controlled storage device 15 in which opening 70 is located.

Still referring to FIG. 9A, torsion spring and motor assembly 40 is shown to include an axle 44. Axle 44 may extend between mounting brackets 42 and may be held in position by mounting brackets 42. In some embodiments, axle 44 is supported at the ends thereof by rotatable bearings held in position by mounting brackets 42. Axle 44 may be rotatable relative to mounting brackets 42 and may define a substantially horizontal axis of rotation 45.

Torsion spring and motor assembly is shown to further include cable reels 47 and cables 49. Cable reels 47 may be rotatably coupled to axle 44 (e.g., via a fixed attachment) and may be rotatable about axis of rotation 45. Cable reels 47 may be mounted along axle 44 immediately interior of mounting brackets 42. Cable reels 47 may be configured to wind or unwind cables 49 (e.g., around cable reels 47) as axle 44 rotates. Cables 49 may have a first end attached to cable reels 47 and a second end attached to perimeter frame 30 (e.g., directly or via one or more intermediate connecting elements). Rotation of cable reels 47 about axis 45 may cause cables 49 to wind or unwind from cable reels 47.

Winding or unwinding cables 49 from cable reels 47 may adjust the unwound length of cables 49 between cable reels 47 and perimeter frame 30. For example, rotation of cable reels 47 in a first direction of rotation may cause cables 49 to wind around cable reels 47, thereby decreasing the unwound length of cables 49 between cable reels 47 and perimeter frame 30. Decreasing the unwound length of cables 49 between cable reels 47 and perimeter frame 30 may cause perimeter frame 30 to be pulled upward toward cable reels 47 and into the raised position. Rotation of cable reels 47 in a second direction of rotation opposite the first direction of rotation may cause cables 49 to unwind from cable reels 47, thereby increasing the unwound length of cables 49 between cable reels 47 and perimeter frame 30. Increasing the unwound length of cables 49 between cable reels 47 and perimeter frame 30 may allow perimeter frame 30 to move downward (e.g., due to the weight of perimeter frame 30 and display case doors 22) and into the lowered position.

Figure 9B:
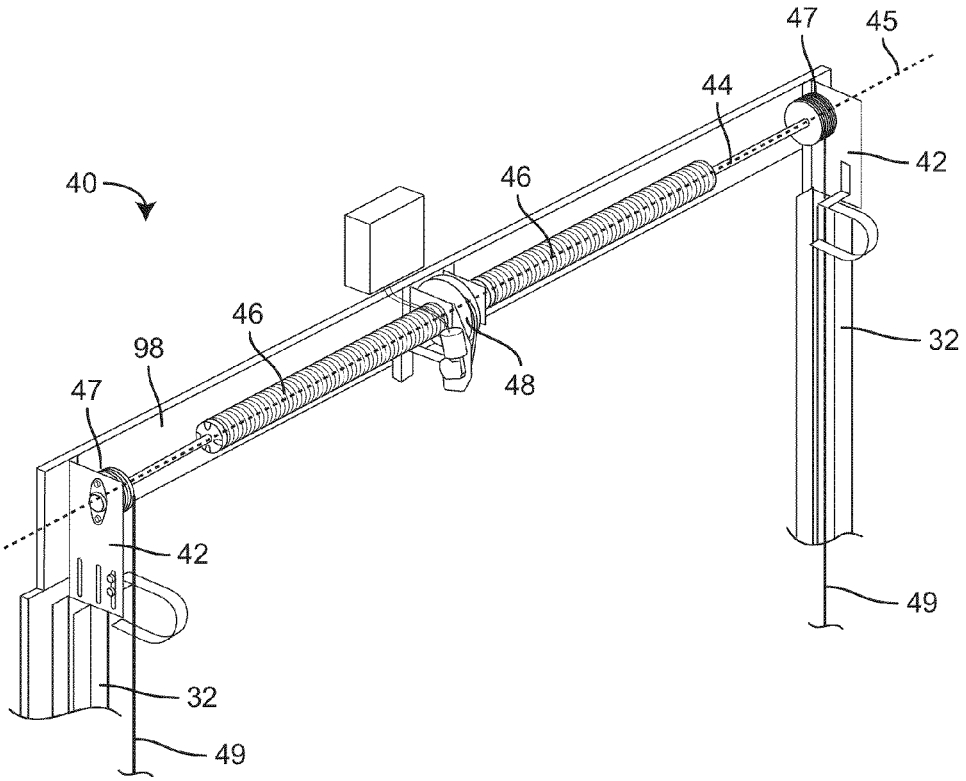
FIG. 9B is a drawing of the torsion spring and motor assembly of FIG. 9A showing a cylindrical cable reel in place of the frustoconical cable reel, according to an exemplary embodiment.

Referring now to FIGS. 9A and 9B, in some embodiments, cable reels 47 may be conical or frustoconical shaped (as shown in FIG. 9A). In other embodiments, cable reels 47 may be cylindrical, substantially cylindrical, or otherwise shaped to have a substantially constant radius along a longitudinal length of cable reels 47 (as shown in FIG. 9B). Advantageously, the substantially cylindrical shape of cable reels 47 shown in FIG. 9B may ensure that the weight of perimeter frame 30 and display case doors 22 is translated into a substantially constant torque about axle 44 as cables 49 wind and unwind from cable reels 47.

Referring again to FIG. 9A, torsion spring and motor assembly 40 is shown to include torsion springs 46. Torsion springs 46 may be mounted along axle 44 and may be rotatably coupled with axle 44. In some embodiments, torsion springs are mounted along axle 44 interior of cable reels 47 (e.g., such that cable reels 47 are between mounting brackets 42 and torsion springs 46).

Torsion springs 46 may be used to facilitate movement of perimeter frame 30 between the lowered position and the raised position by counteracting some or all of the weight of perimeter frame 30 and display case doors 22. For example, when perimeter frame 30 is moved into the lowered position, torsion spring and motor assembly 40 may store energy in torsion springs 46 (e.g., by twisting and/or compressing torsion springs 46). When perimeter frame 30 is moved into the raised position, the stored energy may be released to counteract the weight of perimeter frame 30 and display case doors 22, thereby reducing the external energy required to move perimeter frame 30 and display case doors 22 into the raised position.

In some embodiments, torsion springs 46 are configured to apply a torque to axle 44 in a first direction of rotation. Cable reels 47 may be configured to use the weight of perimeter frame and display case doors 22 to apply a torque to axle 44 in a second direction of rotation opposite the first direction of rotation. Advantageously, by configuring torsion springs 46 and cable reels 47 such that the applied torques are in opposite directions of rotation, the energy stored in torsion springs 46 can be used to counteract the weight of perimeter frame 30 and display case doors 22.

Still referring to FIG. 9A, torsion spring and motor assembly 40 is shown to include a motor 48. Motor 48 may configured to apply a torque to axle 44 to control the rotation of axle 44. In some embodiments, motor 48 is configured to apply a torque in both the first direction of rotation and the second direction of rotation. In other embodiments, motor 48 may be configured to apply a torque in only one direction of rotation and may rely on a torque provided by either torsion springs 46 or the weight of perimeter frame 30 and display case doors 22 to cause rotation of axle 44 in the other direction of rotation. In some embodiments, motor 48 is a DC motor. Motor 48 may be mounted along axle 44 (e.g., between torsion springs 46) and may be configured to apply a torque without requiring a fixed connection to a non-rotating component (e.g., a wall or ceiling connection, etc.). In some embodiments, motor 48 is a torsion-shaft-mounted DC motor.

Figure 10A:
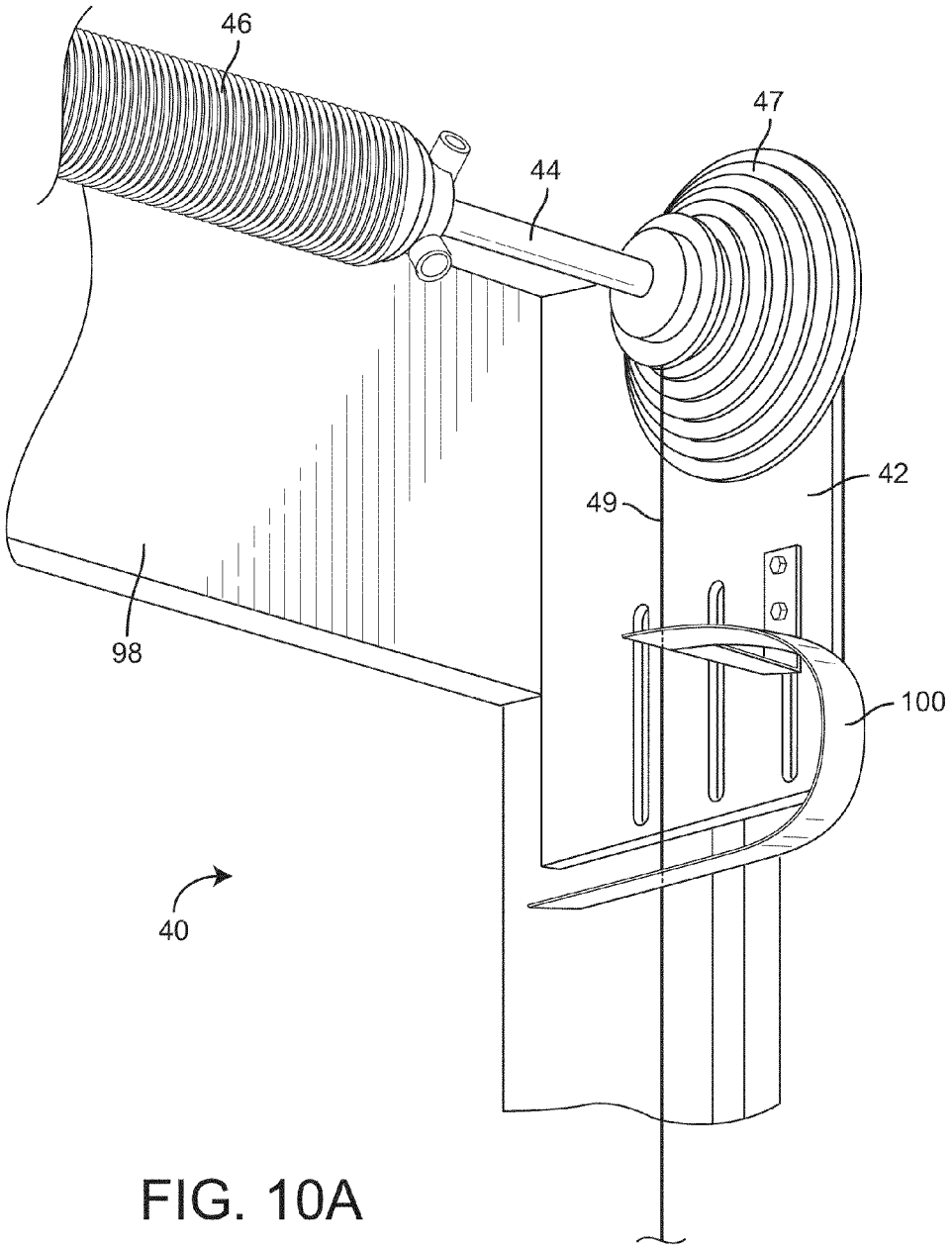
FIG. 10A is a drawing of a cantilever spring attached to an end of the torsion spring and motor assembly of FIG. 9A, illustrating the cantilever spring in a disengaged position and showing a frustoconical cable reel, according to an exemplary embodiment.
Figure 11A:
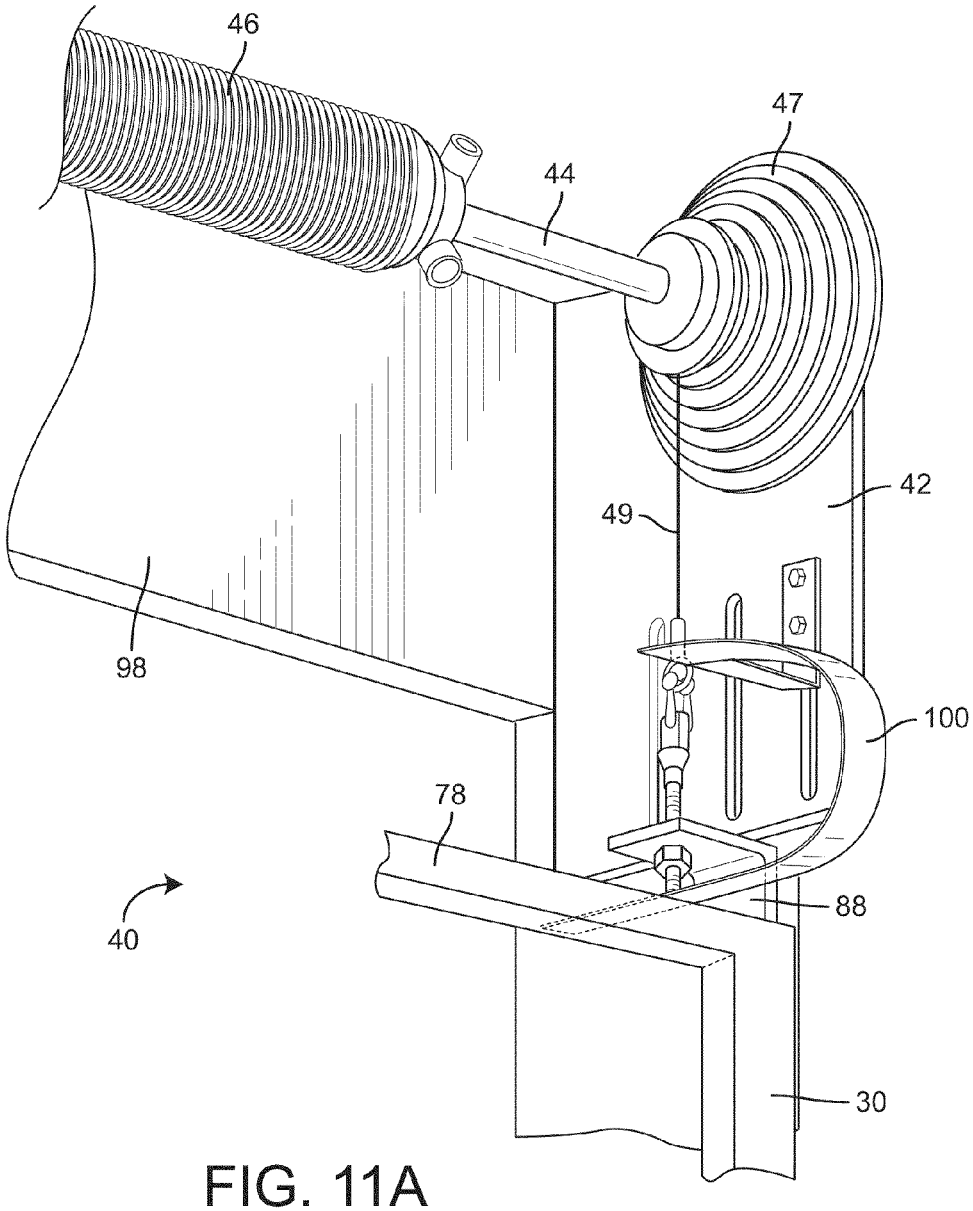
FIG. 11A is a drawing of the cantilever spring of FIG. 10A, illustrating the cantilever spring engaging the perimeter frame when the perimeter frame is in the raised position and showing a frustoconical cable reel, according to an exemplary embodiment.

Referring now to FIGS. 10A and 11A, access system 20 is shown to include a cantilever spring 100. Cantilever spring 100 may be a curved or linear flexible element having a fixed end 102 and a free end 104. Fixed end 102 may be fixedly attached to mounting bracket 42 (e.g., directly or via one or more intermediate connecting elements). In some embodiments, cantilever spring 100 is attached to mounting bracket 42 below cable reel 47. In some embodiments, multiple cantilever springs 100 may be used. For example, cantilever springs 100 may be attached to each of mounting brackets 42 and/or top casing 98. Cantilever spring 100 may be configured to flex between an uncompressed state (shown in FIG. 10A) and a compressed state (shown in FIG. 11A).

Cantilever spring 100 may be configured to engage perimeter frame 30 when perimeter frame 30 is moved toward the raised position. For example, referring specifically to FIG. 11A, cantilever spring is shown engaging top segment 78 as perimeter frame 30 approaches the raised position. Cantilever spring 100 may be configured to apply a downward force to perimeter frame 30, thereby increasing a tension in cables 49 when perimeter frame 30 is close to the raised position. Torsion spring and motor assembly 40 and/or controller 50 may be configured to detect this increased tension and adjust the movement (e.g., speed, position, lifting force, etc.) of perimeter frame 30 in response to the detected increase. In some embodiments, cantilever spring 100 prevents perimeter frame 30 from colliding with the more rigid components of access system 20 (e.g., mounting brackets 42, cable reels 47, etc.) and protects such components from potential wear or damage which could result from a collision.

In FIGS. 10A and 11A, cable reel 47 is shown as a frustoconical cable reel. A frustoconical shape for cable reel 47 may cause the weight of perimeter frame 30 and display case doors 22 to be translated into a variable torque about axle 44 as perimeter frame and display case doors 22 are moved between the raised position and the lowered position (e.g., due to the variable radial distance between axle 44 and cables 49).

Figure 10B:
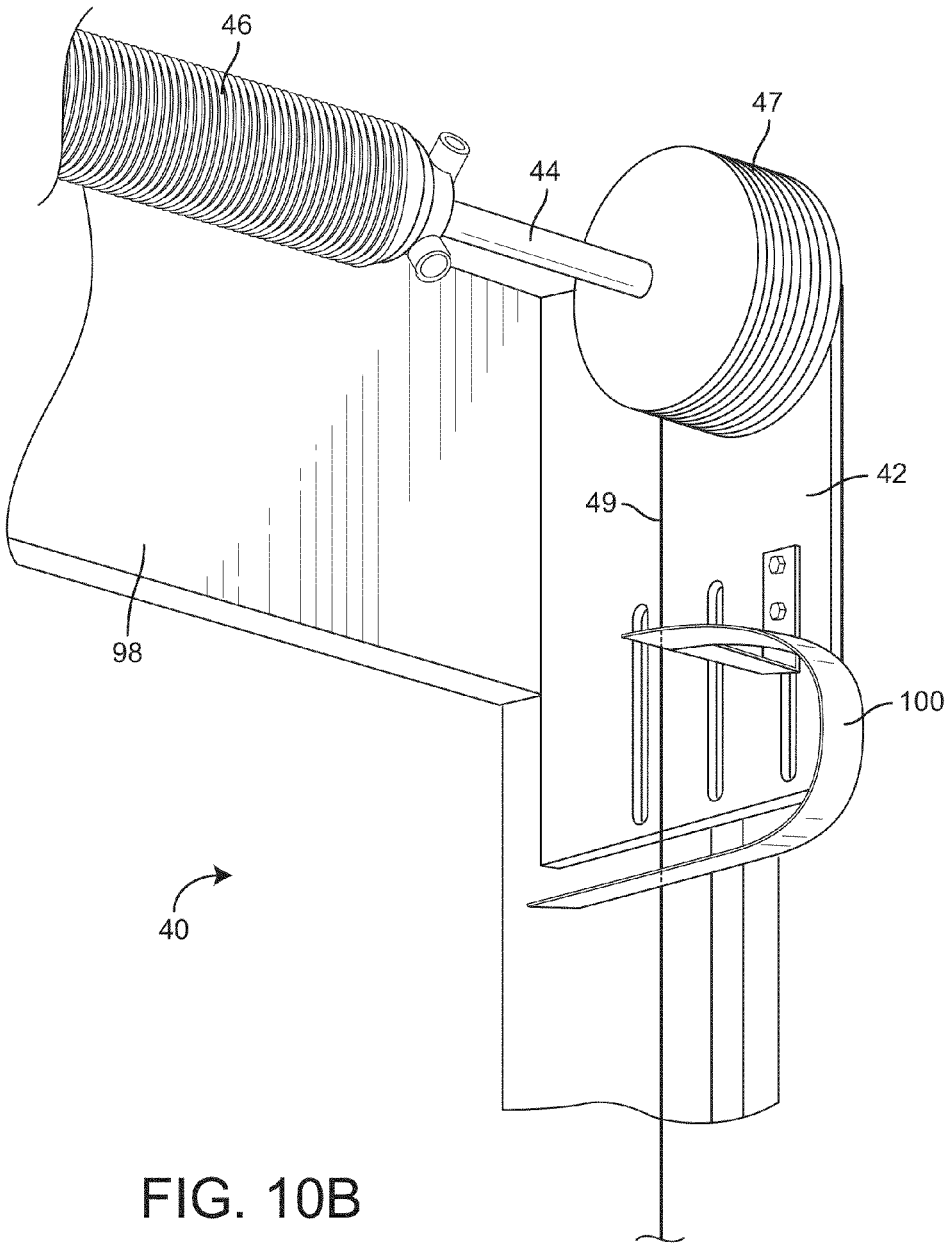
FIG. 10B is a drawing of the cantilever spring attached to an end of the torsion spring and motor assembly of FIG. 9B, illustrating the cantilever spring in a disengaged position and showing a cylindrical cable reel, according to an exemplary embodiment.
Figure 11B:
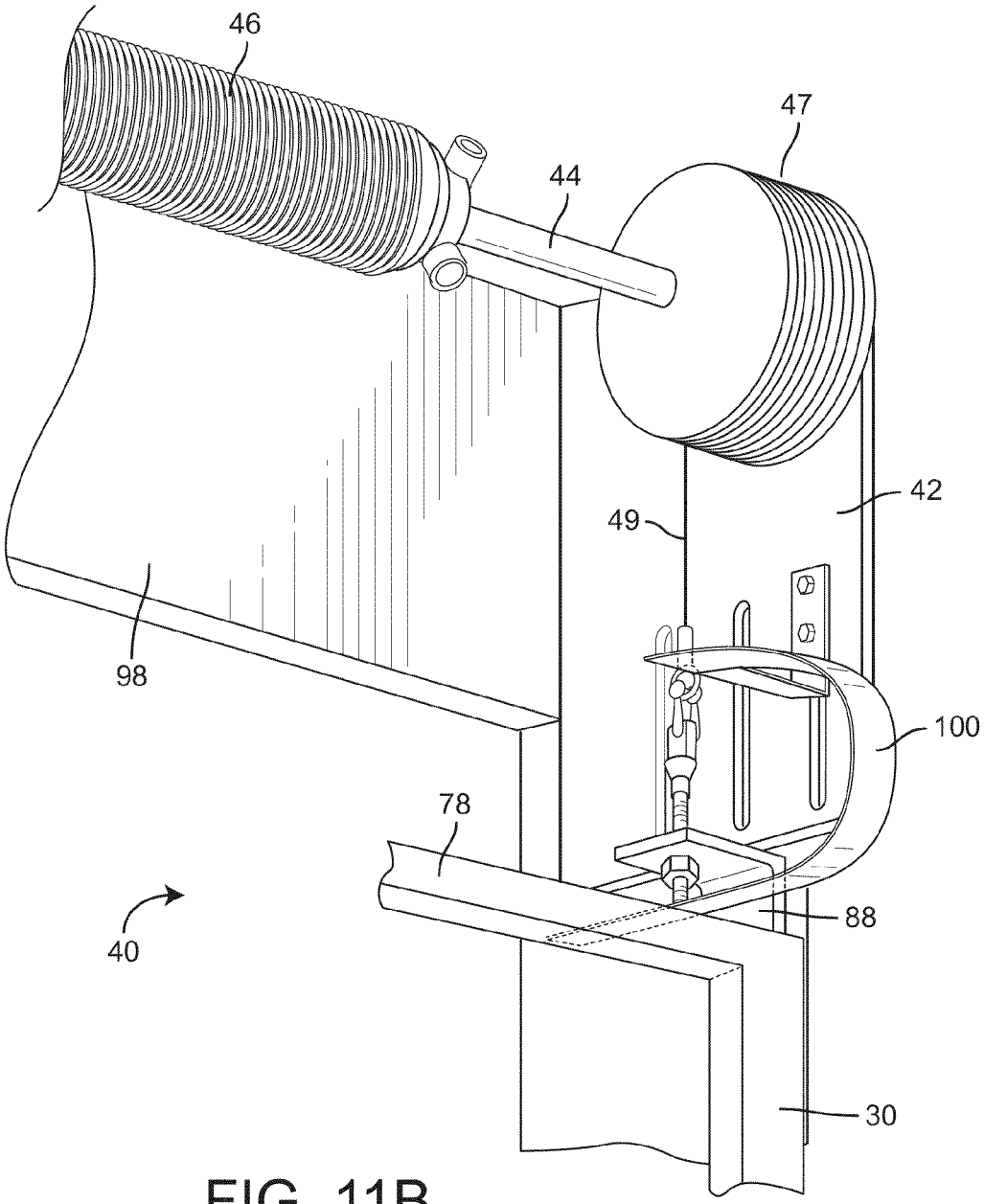
FIG. 11B is a drawing of the cantilever spring of FIG. 10B, illustrating the cantilever spring engaging the perimeter frame when the perimeter frame is in the raised position and showing a cylindrical cable reel, according to an exemplary embodiment.

Referring now to FIGS. 10B and 11B, cable reel 47 is shown as a cylindrical cable reel, according to an alternative exemplary embodiment. Advantageously, a cylindrical shape for cable reel 47 may ensure that cables 49 wind and unwind at a constant radial distance relative to axle 44. The constant radial distance may ensure that the tension in cables 49 (e.g., due to the weight of perimeter frame 30 and display case doors 22) is translated into a substantially constant torque about axle 44 as perimeter frame 30 and display case doors 22 are moved between the raised position and the lowered position.

Figure 12:
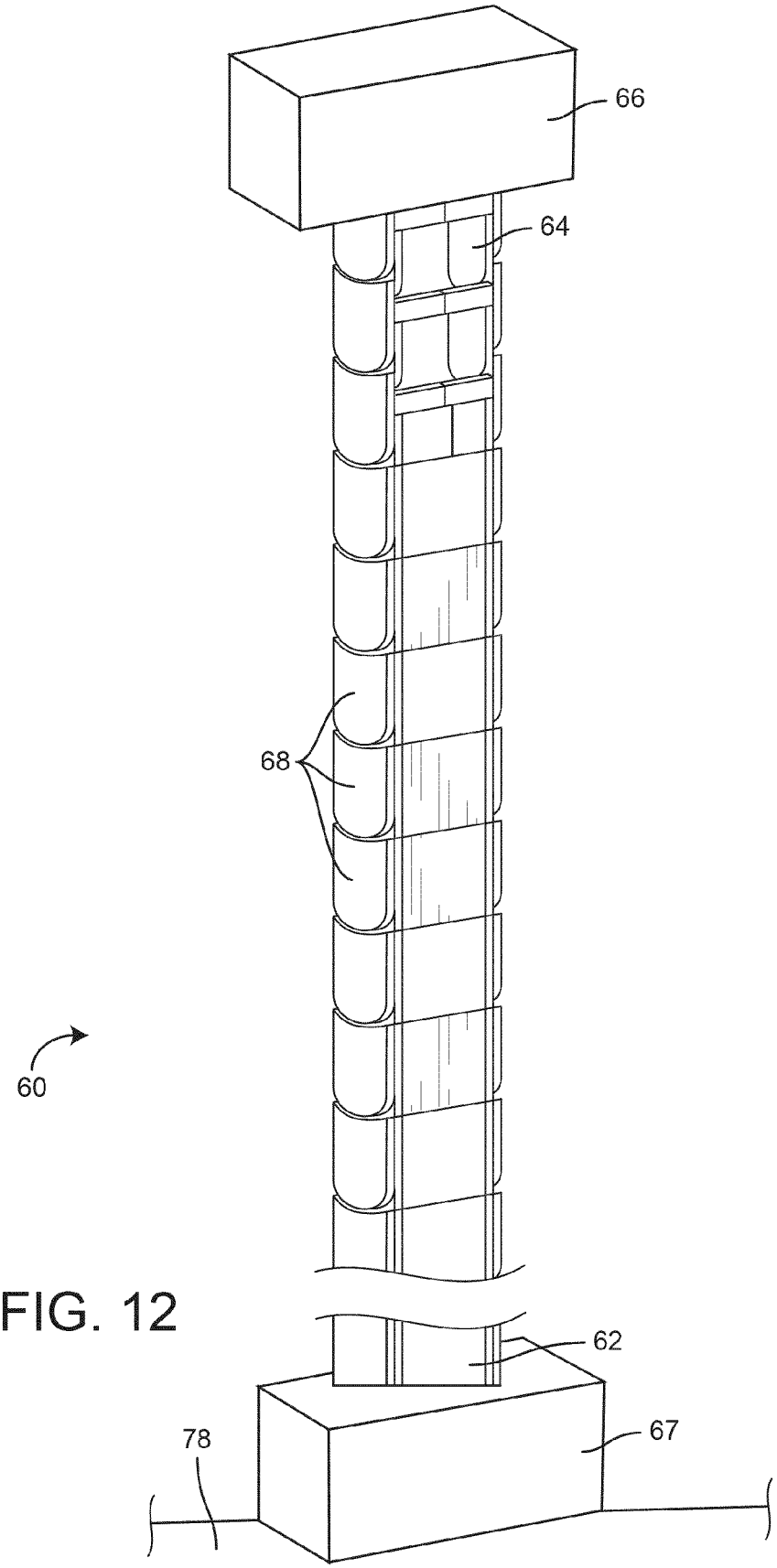
FIG. 12 is a drawing of a cable guide for providing electrical connections to the vertically-movable perimeter frame, according to an exemplary embodiment.

Referring now to FIG. 12, a cable guide 60 is shown in greater detail, according to an exemplary embodiment. Cable guide 60 may provide a flexible and protected path for power cables, signal cables, or other electric conduits used to supply power and/or communicate control signals to display case doors 22 (e.g., through perimeter frame 30). Cable guide 60 may have a first end 62 attached to perimeter frame 30 and a second end 64 attached to a fixed mounting bracket (e.g., mounting bracket 66). First end 62 may be attached to top segment 78 (e.g., near or overlapping opening 86) and may be used to deliver cables into opening 86. In some embodiments, first end 62 is attached to a junction box mounted 67 on top segment 78. First end 62 may be movable along with perimeter frame 30 between the raised position and the lowered position. Fixed mounting bracket 66 may be attached to top casing 98 or an exterior side surface of temperature-controlled storage device 15.

Cable guide 60 may be a flexible chain comprising a plurality of individually-rotatable links 68. Links 68 may be configured to contain wires or other conduits within cable guide 60. Links 68 may be arranged in series (i.e., in a chain) and may be rotatable with respect to adjacent links. In some embodiments, links 68 may be rotatable in only a first direction of rotation relative to adjacent links. This controlled rotation may cause cable guide 60 to bend or fold in a predictable manner (e.g., in a predictable direction, at a predictable angle, etc.) as perimeter frame 30 is moved between the lowered position and the raised position. For example, when perimeter frame 30 is in the lowered position, cable guide 60 may be linear or substantially linear. As perimeter frame 30 is moved toward the raised position, the distance between top segment 58 and mounting bracket 66 may decrease. Cable guide 60 may bend or fold in a predictable manner in response to the decrease in distance between top segment 78 and mounting bracket 66, thereby providing a flexible and protected path for the cables contained therein. In some embodiments, cable guide 60 is an IGUS® brand Energy Chain®, as may be manufactured by IGUS® Inc.

Figure 13:
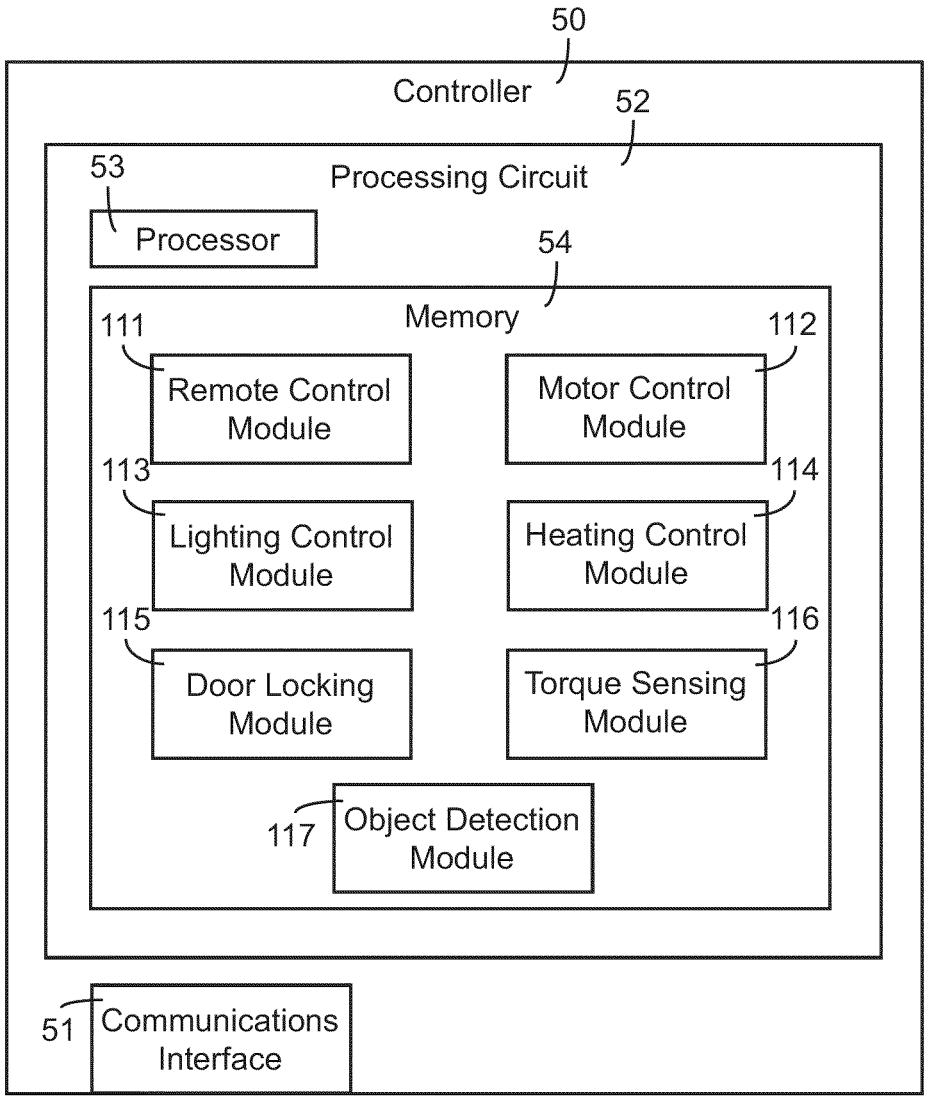
FIG. 13 is a block diagram of a controller for controlling operation of the torsion spring and motor assembly and causing movement of the perimeter frame and display case doors between the raised position and the lowered position, according to an exemplary embodiment.

Referring to FIG. 13, a block diagram of controller 50 is shown, according to an exemplary embodiment. Controller 50 may be configured to operate motor 48 (e.g., by providing a control signal to motor 48, by supplying power to motor 48, etc.) to cause movement of perimeter frame 30 and display case doors 22 between the raised position and the lowered position. In some embodiments, controller 50 may be integrated with motor 48. In other embodiments, controller 50 is a separate component.

Controller 50 is shown to include a communications interface 51 and a processing circuit 52. Communications interface 51 may include wired or wireless interfaces (e.g., jacks, antennas, transmitters, receivers, transceivers, wire terminals, Ethernet ports, WiFi transceivers, etc.) for conducting data communications with local or remote devices or systems. Communications interface 51 may be used to communicate with a wireless networking device (e.g., a wireless router, wireless-enabled computer, laptop, tablet, cell tower, etc.) and/or a wired networking device (e.g., via an Ethernet cable, a SATA cable, USB cable, or other physical data connection).

Communications interface 51 may allow controller 50 to provide control signals to the control devices of access system 20 and receive data signals from the sensory devices of access system 20. For example, communications interface 51 may allow controller 50 to provide control signals to display case doors 22 for operating an electronic component thereof (e.g., an electronic door lock, a heating element, a lighting element, etc.). Controller 50 may provide control signals to display case doors 22 via one or more electrical conduits (e.g. wires, signal cables, etc.) transported through cable guide 60 and connected with communications interface 51. In some embodiments, communications interface 51 is configured to receive input from a sensory device (e.g., an optical sensor, a proximity sensor, a torque sensor, etc.) and/or a user input device (e.g., a hardwired control panel, a remote control device, etc.) for controlling operation of motor 48.

Processing circuit 52 is shown to include a processor 53 and memory 54. Processor 53 may be implemented as a general purpose processor, an application specific integrated circuit (ASIC), one or more field programmable gate arrays (FPGAs), a CPU, a GPU, a group of processing components, or other suitable electronic processing components.

Memory 54 may include one or more devices (e.g., RAM, ROM, Flash® memory, hard disk storage, etc.) for storing data and/or computer code for completing and/or facilitating the various processes, layers, and modules described in the present disclosure. Memory 54 may comprise volatile memory or non-volatile memory. Memory 54 may include database components, object code components, script components, or any other type of information structure for supporting the various activities and information structures described in the present disclosure. In some implementations, memory 54 is communicably connected to processor 53 via processing circuit 52 and includes computer code (e.g., data modules stored in memory 54) for executing one or more control processes described herein.

Still referring to FIG. 13, memory 54 is shown to include a remote control module 111. Remote control module 111 may be configured to receive input from a remote transmitter (e.g., a wireless transmitter, a radio transmitter, a WiFi transmitter, etc.) for facilitating remote control of access system 20. For example, remote control module 111 may receive a wireless data signal from a user-operable remote control device (e.g., in response to a user pressing a button or providing input requesting operation of motor 48). In some embodiments, a single remote control device may provide wireless data signals to a plurality of controllers (e.g., for multiple access systems). Remote control module 111 may be configured to determine whether a particular wireless data signal is intended for controller 50 or for a different controller associated with a different access system.

Remote control module 111 may be configured to process the wireless data signal and identify a control action associated with the wireless data signal. For example, remote control module 111 may determine whether the wireless data signal is an input requesting operation of motor 48, an input requesting activation/deactivation of a lighting element or heating element integrated with display case doors 22, an input requesting locking or unlocking of display case doors 22, an input received from a remote sensor, or any other type of input which may be received remotely by controller 50. Remote control module 111 may communicate the requested control action to one or more of memory modules 112-117 to carry out the requested control action.

Still referring to FIG. 13, memory 54 is shown to include a motor control module 112. Motor control module 112 may be configured to operate motor 48 for moving perimeter frame 30 and display case doors 22 between the lowered position and the raised position. In some embodiments, motor control module 112 controls operation of motor 48 by providing a control signal to motor 48. In other embodiments, motor control module controls operation of motor 48 by supplying power (e.g., DC current, voltage, etc.) to motor 48. Motor control module 112 may be calibrated to accurately and precisely cause movement of perimeter frame 30 and display case doors between the lowered position and the raised position. For example, motor control module 112 may be configured to operate motor 48 for a predetermined time period and/or cause motor 48 to rotate axle 44 through a predetermined number of rotations. The predetermined time period and/or predetermined number of rotations may be specified by a user or automatically determined during initial calibration.

In some embodiments, motor control module 112 operates motor 48 according to one or more interlocks. For example, motor control module 112 may receive an input (e.g., a notification, an alert, an alarm, etc.) from object detection module 117 if an object is detected in the path of perimeter frame 30 during movement between the raised position and the lowered position. An interlock associated with a detected object may cause motor control module 112 to stop or reverse movement of perimeter frame 30 to prevent perimeter frame 30 from contacting the detected object.

As another example, motor control module 112 may receive an input from torque sensing module 116 if the torque applied by motor 48 crosses a threshold value. The threshold value may be a maximum threshold value (e.g., for torques applied while moving perimeter frame 30 toward the raised position) or a minimum threshold value (e.g., for torques applied while moving perimeter frame 30 toward the lowered position). An interlock associated with an applied torque may cause motor control module 112 to stop or reverse movement of perimeter frame 30 (e.g., by deactivating or reversing motor 48).

Still referring to FIG. 13, memory 54 is shown to include a lighting control module 113. Lighting control module 113 may be configured to operate one or more lighting elements (e.g., LED light panels, fluorescent light tubes, incandescent blubs, etc.) integrated with display case doors 22. Lighting control module 113 may be configured to activate the lighting elements to provide improved illumination and product display for the refrigerated or frozen goods stored within temperature-controlled storage device 15. Lighting control module 113 may be configured to deactivate the lighting element to conserve energy when illumination is not required. In some embodiments, lighting control module 113 may operate a lighting element according to a set schedule (e.g., based on the time of day, hours of business, etc.) or according to specific operating instructions (e.g., user input) received via a user input device.

Memory 54 is shown to further include a heating control module 114. Heating control module 114 may be configured to operate one or more heating elements integrated with display case doors 22. Heating control module 114 may be configured to activate the heating elements to provide anti-condensate control, defrost control, or other heating that may be applied to improve product presentation and/or system operation of temperature-controlled storage device 15. Heating control module 114 may receive an input from a sensor (e.g., a temperature sensor, a humidity sensor, a pressure sensor, etc.) located within temperature-controlled storage device 15 or display case doors 22. Heating control module 114 may activate or deactivate the heating element based on the sensory input, according to control instructions stored within controller 50, or in response to specific operating instructions received from a user input device.

Still referring to FIG. 13, memory 54 is shown to include a door locking module 115. Door locking module 115 may be configured to operate electronic door locks integrated with display case doors 22. In some embodiments, door locking module 115 may activate the electronic door locks when perimeter frame 30 and display case doors are in the raised position or during movement between the raised position and the lowered position.

Advantageously, door locking module 115 may prevent display case doors 22 from opening when the door and frame assembly is in the raised position or during transportation between the raised position and the lowered position. Door locking module 115 may receive input from motor control module 112 and/or torque sensing module 116 to determine the vertical position of display case doors 22. In some embodiments, door locking module 115 unlocks display case doors 22 only when display case doors 22 are in the lowered position. Door locking module 115 may activate or deactivate the electronic door locks according to a set schedule (e.g., based on the time of day, hours of business, etc.), according to input received from other memory modules 111-117 within controller 50, and/or in response to specific operating instructions received from a user input device.

Still referring to FIG. 13, memory 54 is shown to include a torque sensing module 116. Torque sensing module 116 may be configured to monitor one or more torques applied to axle 44. The torques applied to axle 44 may include a torque exerted by motor 48, a torque exerted by the weight of perimeter frame 30 and display case doors 22, and/or any other torque or moment applied to axle 44.

Torque sensing module 116 may be configured to determine whether the monitored torque crosses a threshold torque value (e.g., a maximum threshold value, a minimum threshold value, a range of values, etc.). A torque exceeding a maximum threshold value may indicate that motor 48 cannot safely continue moving perimeter frame 30 toward the raised position or that perimeter frame 30 is stuck or blocked from continued movement. A torque less than a minimum threshold value may indicate that a portion of the weight of perimeter frame 30 and display case doors 22 is not being transmitted as an applied torque to axle 44. For example, if perimeter frame 30 encounters an object while moving toward the lowered position, the object may support a portion of the weight of perimeter frame 30 and display case doors 22, thereby decreasing a tension in cables 49 and reducing the torque applied to axle 44.

Torque sensing module 116 may compare the monitored torque with a threshold value and output a notification (e.g., an alert, a warning, a flag, an alarm, etc.) if the torque is less than a minimum threshold value or greater than a maximum threshold value. The notifications generated by torque sensing module 116 may be used as interlocks by motor control module 112, as described above.

Still referring to FIG. 13, memory 54 is shown to include an object detection module 117. Object detection module 117 may be configured to detect an object in a path of perimeter frame 30 during movement between the raised position and the lowered position. In some embodiments, object detection module 117 receives an input from torque sensing module 116 indicating a torque applied to axle 44 (e.g., by motor 48, by the weight of perimeter frame 30 and display case doors 22, etc.). Object detection module 117 may use the input from torque sensing module 116 to determine whether an object is blocking perimeter frame 30 from reaching the lowered position or the raised position.

Figure 14:
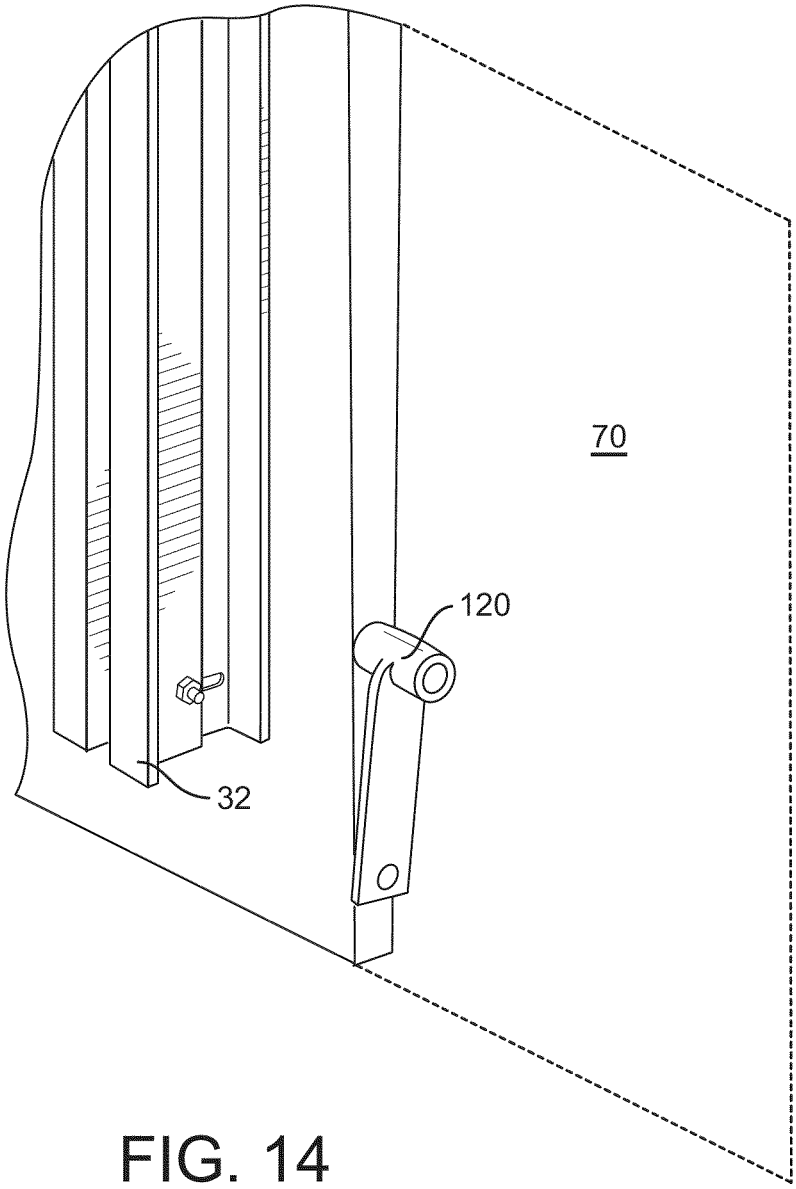
FIG. 14 is a drawing of a sensor for detecting an object in a travel path of the perimeter frame, according to an exemplary embodiment.

Referring now to FIGS. 13-14, object detection module 117 may receive input from one or more sensory devices (e.g., an optical sensor, a microwave sensor, a capacitive sensor, a proximity sensor, etc.) for detecting an object in the path of perimeter frame 30. For example, as shown in FIG. 14, access system 20 may include a sensor 120 positioned near the bottom of opening 70. Sensor 120 may be an optical sensor (e.g., an optical emitter, and optical receiver, a combination emitter and receiver unit, etc.) configured sense an object in the travel path of perimeter frame 30. In other embodiments, sensor 120 may be located above opening 70, to the side of opening 70, or in any other location suitable for detecting an object in the travel path of perimeter frame 30. Object detection module 117 may output a notification (e.g., an alert, a warning, a flag, an alarm, etc.) in response to an object detection. The notifications generated by object detection module 117 may be used as interlocks by motor control module 112.

According to any exemplary embodiment, the various temperature-controlled storage devices of the present disclosure may have different storage temperature requirements (e.g. "low temperature" such as approximately −20° F., or "medium temperature" such as approximately 25° F.). Storage devices may have a variety of applications. One example of a storage device is a refrigerated display case in a supermarket for use in displaying refrigerated or frozen food products. Such temperature-controlled storage devices may have one or more glass doors that provide access to a temperature controlled space, or may have an open front with an air curtain. Temperature-controlled storage devices may also include high temperature storage devices (e.g., other than refrigerators or freezers). All such variations are intended to be within the scope of this disclosure.

It should be noted that references to "left," "right," "top," "bottom," "upward," "downward," "interior," "exterior," "opposite," and "adjacent" in this description are merely used to identify the various elements as they are oriented in the FIGURES. These terms are not meant to limit the element which they describe, as the various elements may be oriented differently in various implementations.

It should further be noted that for purposes of this disclosure, the terms "coupled," "connected," "linked," "attached," and similar terms mean the joining of two members directly or indirectly to one another. Such joining may be stationary in nature or moveable in nature and/or such joining may allow for the flow of fluids, electricity, electrical signals, or other types of signals or communication between the two members. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature.

The terms "approximately," "about," "substantially," and similar terms used herein are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The construction and arrangement of the systems and methods as shown in the various exemplary embodiments are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.). For example, the position of elements may be reversed or otherwise varied and the nature or number of discrete elements or positions may be altered or varied. Accordingly, all such modifications are intended to be included within the scope of the present disclosure. The order or sequence of any process or method steps may be varied or re-sequenced according to alternative embodiments. Other substitutions, modifications, changes, and omissions may be made in the design, operating conditions and arrangement of the exemplary embodiments without departing from the scope of the present disclosure.

As used herein, the word "exemplary" is intended to serve as an example, instance, or illustration. Any embodiment or design described herein as "exemplary" is not necessarily to be construed as preferred or advantageous over other embodiments or designs. Rather, use of the word exemplary is intended to present concepts in a concrete manner.

The present disclosure contemplates methods, systems and program products on any machine-readable media for accomplishing various operations. The embodiments of the present disclosure may be implemented using existing computer processors, or by a special purpose computer processor for an appropriate system, incorporated for this or another purpose, or by a hardwired system. Embodiments within the scope of the present disclosure include program products comprising machine-readable media for carrying or having machine-executable instructions or data structures stored thereon. Such machine-readable media can be any available media that can be accessed by a general purpose or special purpose computer or other machine with a processor. By way of example, such machine-readable media can comprise RAM, ROM, EPROM, EEPROM, CD-ROM or other optical disk storage, magnetic disk storage or other magnetic storage devices, or any other medium which can be used to carry or store desired program code in the form of machine-executable instructions or data structures and which can be accessed by a general purpose or special purpose computer or other machine with a processor. When information is transferred or provided over a network or another communications connection (either hardwired, wireless, or a combination of hardwired or wireless) to a machine, the machine properly views the connection as a machine-readable medium. Thus, any such connection is properly termed a machine-readable medium. Combinations of the above are also included within the scope of machine-readable media. Machine-executable instructions include, for example, instructions and data which cause a general purpose computer, special purpose computer, or special purpose processing machines to perform a certain function or group of functions.

Although the figures show a specific order of method steps, the order of the steps may differ from what is depicted. Also two or more steps may be performed concurrently or with partial concurrence. Such variation will depend on the software and hardware systems chosen and on designer choice. All such variations are within the scope of the disclosure. Likewise, software implementations could be accomplished with standard programming techniques with rule based logic and other logic to accomplish the various connection steps, processing steps, comparison steps and decision steps.

What is claimed is:

1. An access system for a temperature-controlled storage device, the access system comprising:

a perimeter frame configured to move substantially vertically along a surface of the temperature-controlled storage device between a raised position and a lowered position, wherein moving the perimeter frame into the raised position exposes an opening into a temperature-controlled space within the temperature-controlled storage device;

a plurality of substantially transparent display case doors mounted within the perimeter frame and configured to move along with the perimeter frame between the raised position and the lowered position, wherein the plurality of display case doors substantially cover the opening when the perimeter frame and the display case doors are in the lowered position and are configured to facilitate presentation of items within the temperature-controlled space, wherein each of the display case doors is configured to rotate substantially horizontally between an open position and a closed position when the perimeter frame is in the lowered position and provides access to the same temperature-controlled space through a different portion of the opening; and a torsion spring assembly coupled to the perimeter frame and configured to counteract a weight of the perimeter frame and the plurality of display case doors, wherein the torsion spring assembly is configured to store energy when the perimeter frame and the plurality of display case doors are moved into the lowered position and to release the stored energy when the perimeter frame and the plurality of display case doors are moved into the raised position.

2. The system of claim 1, further comprising:

a guide channel attached to the surface of the temperature-controlled display storage device, wherein the guide channel defines a substantially vertical path along which the perimeter frame is movable between the raised position and the lowered position; and at least one guide element positionally fixed to a side surface of the perimeter frame and configured to slide along the substantially vertical path defined by the guide channel.

3. The system of claim 1, wherein the torsion spring assembly includes:

an axle;

a cable reel rotatably coupled to the axle and rotatable about an axis defined by the axle; and a cable having a first end attached to the cable reel and a second end attached to the perimeter frame, wherein rotation of the cable reel about the axis adjusts a length of cable between the cable reel and the perimeter frame.

4. The system of claim 3, wherein the torsion spring is configured to apply a torque to the axle in a first direction of rotation;

wherein rotation of the axle in the first direction of rotation causes the cable to wind around the cable reel, thereby decreasing the length of cable between the cable reel and the perimeter frame and moving the perimeter frame and the plurality of display case doors into the raised position.

5. The system of claim 3, wherein the weight of the perimeter frame and the plurality of display case doors is configured to apply a torque to the axle in a second direction of rotation opposite the first direction of rotation;

wherein rotation of the axle in the second direction of rotation causes the cable to unwind from the cable reel, thereby increasing the length of cable between the cable reel and the perimeter frame and allowing the perimeter frame and the plurality of display case doors to move into the lowered position.

6. The system of claim 3, further comprising:

a motor coupled to the axle and configured to apply a torque to the axle, wherein the motor is operable to cause movement of the perimeter frame and the plurality of display case doors between the raised position and the lowered position.

7. The system of claim 6, further comprising:

a controller configured to operate the motor for controlling movement of the perimeter frame and the plurality of display case doors between the raised position and the lowered position.

8. The system of claim 1, wherein the plurality of display case doors includes an electrical component;

wherein the perimeter frame includes an opening extending therethrough, the opening configured to receive an electrical conduit for providing an electrical connection through the perimeter frame to the plurality of display case doors.

9. The system of claim 8, further comprising:

a cable guide having a first end attached to the perimeter frame and movable along with the perimeter frame between the raised position and the lowered position and a second end attached to a fixed mounting bracket;

wherein the cable guide is configured to bend in a predictable manner when the perimeter frame is moved between the raised position and the lowered position and to provide a flexible and protected path for the electrical conduit.

10. An access system for a temperature-controlled storage device, the access system comprising:

a display case door assembly including an interior frame and a plurality of substantially transparent display case doors mounted within the interior frame, wherein the plurality of display case doors substantially cover an opening into a temperature-controlled space within the temperature-controlled storage device and are configured to facilitate presentation of items within the temperature-controlled space, wherein each of the display case doors is configured to rotate about a substantially vertical axis of rotation between an open position and a closed position and provides access to the same temperature-controlled space through a different portion of the opening;

a perimeter frame fixedly attached to the interior frame along an outer perimeter of the interior frame, wherein the perimeter frame is configured to move substantially vertically between a raised position in which the perimeter frame uncovers the opening in the temperature-controlled storage device and a lowered position in which the perimeter frame covers the opening in the temperature-controlled storage device;

a torsion spring and motor assembly coupled to the perimeter frame and configured to move the perimeter frame and display case door assembly between the raised position and the lowered position; and a controller configured to operate the torsion spring and motor assembly to move the perimeter frame and display case door assembly between the raised position and the lowered position.

11. The system of claim 10, wherein the perimeter frame includes an opening extending therethrough, the opening configured to receive an electrical conduit for providing an electrical connection through the perimeter frame to the display case door assembly.

12. The system of claim 10, wherein the display case door assembly includes an electrical component;

wherein the controller is configured to provide a control signal to the display case door assembly for operating the electrical component of the display case door assembly.

13. The system of claim 12, wherein the electrical component of the display case door assembly includes at least one of: a lighting element, a heating element, and an electronic door lock.

14. The system of claim 10, wherein the display case door assembly includes an electronic door lock;

wherein the controller is configured to provide a control signal to the display case door assembly for operating the electronic door lock;

wherein the controller is configured to lock the display case door assembly when the perimeter frame and display case door assembly are in the raised position and during movement between the raised position and the lowered position.

15. The system of claim 10, wherein the controller is configured to detect an object in a path of the perimeter frame and display case door assembly during movement between the raised position and the lowered position;

wherein the controller is configured to reverse a movement direction of the perimeter frame and display case door assembly in response to detecting the object.

16. The system of claim 15, wherein detecting an object in the path of the perimeter frame and display case door assembly includes at least one of:

monitoring a signal from a sensor configured to sense an object in the path of the perimeter frame and display case door assembly; and monitoring a torque measured by the torsion spring and motor assembly during movement of the perimeter frame and display case door assembly.

17. The system of claim 10, wherein the controller is configured to receive an input from a remote control device;

wherein the controller is configured to operate the torsion spring and motor assembly in response to the input received from the remote control device.

18. An access system for a temperature-controlled storage device, the access system comprising:

one or more guide channels fixed to an exterior surface of the temperature-controlled storage device and extending substantially vertically adjacent to an opening into a temperature-controlled space within the temperature-controlled storage device;

a perimeter frame configured to move substantially vertically along a path defined by the one or more guide channels between a raised position in which the perimeter frame uncovers the opening in the temperature-controlled storage device and a lowered position in which the perimeter frame covers the opening in the temperature-controlled storage device;

a plurality of substantially transparent display case doors mounted within the perimeter frame and configured to move along with the perimeter frame between the raised position and the lowered position, wherein the plurality of display case doors substantially cover an opening into the temperature-controlled space and are configured to facilitate presentation of items within the temperature-controlled space;

wherein each of the display case doors is configured to rotate about a substantially vertical axis of rotation coplanar with the perimeter frame between a closed position in which the display case door prevents access to the temperature-controlled storage device and an open position in which the display case door allows access to the temperature-controlled storage device through a portion of the opening, wherein each of the display case doors provides access to the same temperature-controlled space through a different portion of the opening.

19. The system of claim 18, further comprising:

a torsion spring and motor assembly coupled to the perimeter frame and configured to move the perimeter frame and the plurality of display case doors between the raised position and the lowered position.

20. The system of claim 19, further comprising:

a controller configured to operate the torsion spring and motor assembly to move the perimeter frame and the plurality of display case doors between the raised position and the lowered position.

* * * * *